US011559174B2

(12) United States Patent
Elliott et al.

(10) Patent No.: US 11,559,174 B2
(45) Date of Patent: Jan. 24, 2023

(54) DISPENSER FOR ROLLS OF ABSORBENT PAPER MATERIAL

(71) Applicant: Essity Hygiene and Health Aktiebolag, Gothenburg (SE)

(72) Inventors: Adam T. Elliott, Lexington, KY (US); Christian Kasilag, Philadelphia, PA (US); Brian Weingarth, Philadelphia, PA (US); Aaron Pavkov, Philadelphia, PA (US)

(73) Assignee: ESSITY HYGIENE AND HEALTH AKTIEBOLAG, Gothenburg (SE)

( * ) Notice: Subject to any disclaimer, the term of this patent is extended or adjusted under 35 U.S.C. 154(b) by 0 days.

(21) Appl. No.: 17/631,749

(22) PCT Filed: Oct. 30, 2019

(86) PCT No.: PCT/SE2019/051083

§ 371 (c)(1),
(2) Date: Jan. 31, 2022

(87) PCT Pub. No.: WO2021/086239

PCT Pub. Date: May 6, 2021

(65) Prior Publication Data

US 2022/0313030 A1 Oct. 6, 2022

(51) Int. Cl.
*A47K 10/32* (2006.01)

(52) U.S. Cl.
CPC ..... *A47K 10/32* (2013.01); *A47K 2010/3253* (2013.01)

(58) Field of Classification Search
CPC ..... A47K 10/32
See application file for complete search history.

(56) References Cited

U.S. PATENT DOCUMENTS 3,650,487 A 3/1972 Bahnsen
3,677,485 A 7/1972 Berg
(Continued)

FOREIGN PATENT DOCUMENTS

EP 3549500 A1 10/2019

OTHER PUBLICATIONS

International Search Report (PCT/ISA/210) and Written Opinion (PCT/ISA/237) dated Jun. 23, 2020, by the Swedish Patent Office as the International Searching Authority for International Application No. PCT/SE2019/051083. (11 pages).

*Primary Examiner* — Gene O Crawford
*Assistant Examiner* — Ayodeji T Ojofeitimi
(74) *Attorney, Agent, or Firm* — Buchanan Ingersoll & Rooney PC

(57) ABSTRACT

A dispenser including two roll supports; and a housing, the dispenser configured such that the roll supports can assume the following positions relative to the housing: at least one dispensing position for a roll support of the two roll supports, and a storage position for a roll support of the two roll supports, the dispenser configured for allowing dispensing from a roll arranged on a roll support of the two roll supports which is in the dispensing position and for storage of a roll arranged on a roll support of the two roll supports which is in the storage position; the dispenser configured to provide a first state, wherein a first roll support of the roll supports is in the dispensing position and a second roll support of the roll supports is in the storage position, and a second state, wherein the second roll support is in a dispensing position.

30 Claims, 11 Drawing Sheets

(56) References Cited

U.S. PATENT DOCUMENTS

| | | | | |
|---|---|---|---|---|
| 4,844,361 | A | 7/1989 | Granger | |
| 4,856,724 | A * | 8/1989 | Jespersen | A47K 10/3656 242/560.1 |
| 5,288,032 | A * | 2/1994 | Boone | A47K 10/36 242/560.3 |
| 7,967,235 | B2 | 6/2011 | Forman et al. | |
| 8,800,415 | B2 * | 8/2014 | Osborne | A47K 10/3618 83/369 |
| 2005/0127232 | A1 * | 6/2005 | Moody | H03K 17/955 242/564.4 |
| 2006/0236836 | A1 | 10/2006 | Cassia | |

* cited by examiner

DISPENSER FOR ROLLS OF ABSORBENT PAPER MATERIAL

TECHNICAL FIELD

The present disclosure relates to a dispenser arranged for housing at least two rolls of rolled up absorbent paper material. The dispenser comprises a mandrel member comprising two roll supports; and a housing defining at least one dispensing position for a roll support and a storage position for a roll support of said two roll supports. The disclosure also relates to a method for replenishing a dispenser, and to a mandrel member.

BACKGROUND

Dispensers for rolls of absorbent paper, such as hygiene paper or wiping paper may comprise a housing configured to house at least two rolls. In such dispensers it may generally be desired that absorbent paper is initially dispensed from one out of the two rolls, and that absorbent paper from the other roll is presented to the user only once the first roll is completely or close to depleted.

To this end, existing dispensers may include arrangements for dispensing material from a first roll arranged in a dispensing position in the dispenser, while storing another roll in a storage position in the dispenser. Also, existing dispensers may be arranged for automatically transferring the stored roll into the dispensing position once the first roll is spent or nearly spent.

Since the dispensers will be used in public environments, they will be attended by staff regularly checking the status and function of the dispensers. For a dispenser where the second roll is already in a dispensing position, it is generally desired that a new roll may be introduced and stored in the dispenser before the second roll is completely depleted. It is generally desired that the manouever of reloading the dispenser with a new roll may be performed swiftly and conveniently.

Moreover, since the dispensers may be arranged in public spaces wherein several other commodities are to be arranged, it is generally desired that the dispensers function and are reloadable within a relatively confined space.

U.S. Pat. No. 7,967,235 relates to a two-roll toilet paper dispenser which automatically transfers a new roll into dispensing position once the previous roll is spent or nearly spent. The mandrel and track structure permits reloading the dispenser without removing the mandrel.

U.S. Pat. No. 3,677,485 relates to a paper roll dispenser adapted to sequentially dispense paper from a plurality of paper rolls and including a pair of roll mounting spindles having interconnecting linkage for positioning the spindles in spaced parallel relation.

US 2006/0236836 relates to a dispensing device comprising a case and a mechanism for automatically replacing the finished roll with a spare roll.

It is desired to provide a dispenser for at least two rolls as set out in the above, which dispenser enables automatic dispensing from a second roll when a first roll is spent or nearly spent, and which is easy to use and/or to refill. Also, it is desired to provide a dispenser which is advantageous from a manufacturing and/or cost perspective.

SUMMARY

A dispenser fulfilling one or more of the above-mentioned needs is provided by a dispenser according to claim 1.

The dispenser may be used for housing rolls having a core or for coreless rolls. The rolls may comprise absorbent paper or other web-shaped rolled up material.

Hence, there is provided a dispenser arranged for housing at least two rolls of rolled up absorbent paper material, in particular for rolled up absorbent paper. The dispenser comprises a mandrel member comprising two roll supports, each roll support being configured for suspending a roll rotatably about a roll support axis; and a housing. The dispenser is configured such that the roll supports can assume the following positions relative to the housing: at least one dispensing position for a roll support of said two roll supports, and a storage position for a roll support of said two roll supports. The dispenser is configured for allowing dispensing from a roll of material arranged on a roll support of said two roll supports which is in said dispensing position, and for storage of another roll arranged on a roll support of said two roll supports which is in said storage position.

The dispenser is configured to provide a first state, wherein a first roll support of said roll supports is in said dispensing position, and a second roll support of said roll supports is in said storage position.

Moreover, the dispenser is configured to provide a second state, wherein said second roll support is in a dispensing position, and said first roll support is in another position than said storage position.

The mandrel member defines a guide member along which the two roll supports are movable relative to each other such that the mandrel member displays an extended condition and a collapsed condition, wherein a minimum distance between the roll support axes of the two roll supports is shorter in said collapsed condition than in said extended condition.

According to the dispenser as proposed herein, when the dispenser is in the first state, the mandrel member is in said extended condition, and when the dispenser is in the second state, the mandrel member is in said collapsed condition.

A dispenser in accordance with the present disclosure permits for efficient use of space, since the distance between the roll supports may be adjusted between the first and the second state of the dispenser. Accordingly, the outer dimensions of the dispenser when in use may be relatively small. Further, a dispenser in accordance with the present disclosure permits, as will be described in the following, reloading of the dispenser without removing the mandrel member. Further, as will also be explained in the below, it also enables a stored roll to substantially be arranged in the same position as a first used roll during dispensing. Also, the above advantages may be obtained using a relatively simple and robust construction of the mandrel member.

Optionally, the dispenser is configured such that the roll supports further can assume the following position relative to the housing: at least one depleted position for a roll support of said two roll supports, the dispenser being configured for holding said roll support in said depleted position when the material of the roll carried by said roll support is depleted, and wherein, in said second state of said dispenser, said first roll support is in said depleted position.

Since in the second state of the dispenser, the mandrel member is in its collapsed condition, the depleted position may be relatively close to the dispensing position, which implies that the space required inside the dispenser for storing a depleted roll support may be restricted.

The dispenser may provide for more than one dispensing position for a roll support of the two roll supports. Preferably, the available dispensing positions are close to each other, i.e. material from a roll arranged on a roll support which is in any dispensing position is dispensed via the same dispensing opening. However, that more than one dispensing position is available is to say that a slight deviation in the exact location of the roll support inside the dispenser is allowable.

Optionally, in the second state of said dispenser, the second roll support is in a dispensing position deviating from the dispensing position assumed by the first roll support in said first state by less than 20% of a length between the first roll support and the second roll support when the dispenser is in said first state, preferably deviating from the dispensing position assumed by the first roll support in said first state by less than 10% of said length, most preferred deviating from the dispensing position assumed by the first roll support in said first state by less than 5% of said length.

Optionally, in the second state of said dispenser, the second roll support is in the same dispensing position as occupied by the first roll support in the first state of said dispenser.

That the dispensing position of the second roll support in the second state of the dispenser is the same or close to the same as the dispensing position of the first roll support in the first state of said dispenser is advantageous since it allows for optimum adaptation between the dispensing position and other dispensing arrangements of the dispenser, such as the location and size of a dispensing opening.

Optionally, the orientation of the mandrel member in said second state of the dispenser is pivoted in relation to the orientation of the mandrel member in the first state. This option may provide for an efficient use of the space inside the dispenser.

Optionally, the dispenser is configured such that the storage position is vertically above said dispensing position(s). This arrangement is useful from a dispensing point of view, and also enables using the action of gravity for moving the dispenser from the first state to the second state.

Optionally, the location of the vertically uppermost portion of the mandrel member in said second state of the dispenser is vertically below the location of the vertically uppermost portion of the mandrel member in said first state of the dispenser, and/or the location of the vertically lowest portion of the mandrel member in said second state of the dispenser is vertically below the vertically lowest portion of the mandrel member in said first state of the dispenser.

In other words, the mandrel member as a whole may move downwards in relation to the housing when the dispenser is moved from the first state to the second state.

Optionally, the dispenser is configured such that the roll supports further can assume the following position relative to the housing: a refill position located outside of said housing, wherein to provide said refill position, a part of said mandrel member is located outside of said housing. Further, the dispenser is according to this option configured for providing access to a roll support of said two roll supports which is in said refill position for arranging a new roll of material on said roll support. Moreover, the dispenser is configured to provide a third state, wherein said first roll support of said roll supports is in said refill position.

With the above arrangement, in a third state, the first roll support assumes a refill position outside of the housing, which allows for arranging a new roll of material on the first roll support.

In the third state, a part of the mandrel member is located outside of the housing to provide said first roll support of the mandrel member in the refill position outside the housing.

Preferably, in the third state, another part of the mandrel member is located inside the housing. This allows for convenient refill of a new roll to the dispenser.

Optionally, when in the third state, the second roll support is in said dispensing position. Accordingly, the second roll support need not be removed from the dispensing position while moving a part of the mandrel member outside of the housing to provide the first roll support in the refill position.

Optionally, the orientation of the mandrel member when the dispenser is in the third state is pivoted in relation to the orientation of the mandrel member when the dispenser is in the second state.

Optionally, the orientation of the mandrel member is pivoted about said second roll support in relation to the orientation of the mandrel member in said second state.

Optionally, in said third state, the mandrel member is in an expanded condition. This allows for achieving a sufficient distance between the first roll support, which is in the refill position, to the housing and/or to a roll arranged on the second roll support, to house a new roll of material.

Optionally, the dispenser is movable from said third state to said first state, wherein said movement from the third state to the first state implies that the mandrel member is moved from a first configuration, in which said first roll support is one out of said two roll supports to a second configuration, in which said first roll support is the other out of said two roll supports. Accordingly, the dispenser is reset to the first state after refilling with a new roll of material.

Optionally, the dispenser is movable from said third state to said first state by said mandrel member being pivotable about said second roll support.

Optionally, the dispenser is movable from said first to said second state, and from said second state to said third state, while the mandrel member stays in the same configuration, with said first roll support being one and the same out of said two roll supports.

Optionally, said distance between the support axes of the two roll supports in said collapsed condition is less than 75% of the distance between the support axes of the two roll supports in said extended condition, preferably less than 65%, preferably less than 55%.

Optionally, said distance between the support axes of two roll supports in said collapsed condition is greater than 50% of the distance between support axes the roll supports in said extended condition, preferably 50-75%, more preferred 50-65%, most preferred 50-55%.

As such, the mandrel member defines a mandrel member centre, being located centrally between said two roll supports when the mandrel member is in the extended condition, as seen in a plane perpendicular to the roll support axes.

Optionally, the two roll supports are both symmetrically movable along the guide member with respect to the mandrel member centre.

The symmetrical arrangement allows for the resetting of the dispenser from the third state to the first state by pivoting the mandrel member, as described in the above.

With "symmetrically movable" is meant that each of the roll supports is movable towards the centre of the mandrel member in a similar manner as the other roll support is movable towards the centre of the mandrel member. Again, this allows for the resetting of the dispenser from the third state to the first state by pivoting the mandrel member, as described in the above.

Optionally, the collapsed condition of the mandrel member corresponds to the two roll supports being in either of two symmetrical arrangements with respect to the mandrel member centre. The two arrangements are symmetrical in the sense that they have a similar configuration with respect to the mandrel member centre. In particular, one of the two arrangements may imply that the two roll supports are both present on one side of the mandrel member centre, when the other of the two arrangements implies that the two roll supports are both present on the other side of the mandrel member centre.

Again, this allows for the mandrel member to be rotated in relation to the dispenser while repeatedly moving from the first state to the third state and again to the first state.

Optionally, the guide member is symmetrical with respect to the mandrel member centre, as seen in a plane perpendicular to the roll support axes.

Optionally, the guide member defines a straight guide portion extending from one out of said two roll supports to the other out of said two roll supports when the mandrel member is in the extended condition, such that the first roll support and/or the second roll support are movable along a straight line between the extended condition and the collapsed condition.

That the roll supports are movable along a guide member is meant to encompass any telescopic arrangement of the guide member. For example, the two roll supports could be arranged to two corresponding guide member portions, which are telescopically arranged to provide an extended condition and a collapsed condition.

Optionally, and preferred is however, that the guide member has a constant guiding length, and the two roll supports are movable along said guiding length.

Optionally, the roll supports are slidably arranged to said guide member.

Optionally, in said extended condition of the mandrel member, said two roll supports each assume a corresponding outermost position along said guide member.

Optionally, in said collapsed condition of the mandrel member, one roll support of said two roll supports assumes it outermost position and the other roll support of said two roll supports assumes another position along the guide member than its outermost position.

Optionally, said first roll support comprises a first roll support portion defining said roll support axis for holding a roll of material, and a second roll support portion arranged to the guide member, and the second roll support comprises a first roll support portion defining said roll support axis for holding a roll of material, and a second roll support portion arranged to the guide member.

Optionally, said second roll support portions of said first and/or second roll supports extend beyond said first roll support portions in the directions towards each other along said guide member, and when the mandrel member is in said collapsed condition, the second roll support portions of the first and second roll supports abut each other.

Optionally, the mandrel member comprises at least retaining member between said guide member and said first and/or second roll supports for maintaining the mandrel member in a collapsed condition.

Optionally, the retaining member provides for maintaining the mandrel member in a collapsed condition in a releasable manner. Optionally, the retaining member is arranged to release the mandrel member form the collapsed condition upon a user applying a pull force to the mandrel member.

Optionally, the retaining member provides for frictional engagement between the guide member and the roll supports, for maintaining the mandrel member in a collapsed condition.

Optionally, the retaining member provides for snap-fit engagement between the guide member and the roll supports, for maintaining the mandrel member in a collapsed condition.

Optionally, the guide member comprises said retaining member.

Optionally, the guide member comprises a protrusion forming said retaining member.

Optionally, the dispenser is configured such that a transition of the dispenser from said first state to said second state implies transferring said mandrel member from said extended condition to said compressed condition by action of gravity on a roll positioned on said second roll support.

Optionally, the dispenser comprises a trigger arrangement for actuating said transition of the dispenser from said first state to said second state.

Optionally, said trigger arrangement comprises a sensing element for sensing the amount of material on a roll positioned on a roll support of said two roll supports which is in the dispensing position, and a hatch member arranged to retain the other roll support of said two roll supports in said storage position, the sensing element and the hatch member being coupled so as to release the hatch member upon the sensing element sensing that the roll on the roll support which is in the dispensing position is depleted.

Optionally, said trigger arrangement comprises a mechanical sensing element, arranged for sensing the amount of material on a roll positioned on a roll support of said two roll supports which is in the dispensing position, and a hatch member arranged to retain the other roll support in said storage position, the mechanical sensing element and the hatch member being mechanically coupled so as to release the hatch member upon the mechanical sensing element assuming a position corresponding to said roll on the roll support which is in said dispensing position being depleted, allowing the other roll support and to fall downwards by action of gravity.

Optionally, said housing comprises a guide arrangement arranged to guide the pivoting of the mandrel member when the dispenser is moved from said first state to said second state, and/or from said second state to said third state, and/or from said third state to said first state.

Optionally, the dispenser comprises a gate member arranged to act as a barrier in the guide arrangement. As such, the gate member is configured to allow the mandrel to fall down through the guide arrangement, but so as to prevent the first roll support from being pulled upwards past the gate member. Accordingly, the gate member is configured to hinder the roll in the dispensing position from being lifted and thus collapsing the mandrel.

The gate member may be however be arranged at a distance from the dispensing position which may allow a roll provided on the first roll support to be lifted slightly from the dispensing position.

Optionally, the gate member may be configured to provide a limited passage in an upward direction from the dispensing position. so allow a roll having a limited diameter to be pulled upwards past the gate member. Optionally, the gate member may be configured to allow a roll having a diameter less than 25 mm to be pulled upwards past the gate member.

Allowing rolls having a limited diameter to be pulled upwards from the dispensing position allows for the user to cause a bypass, such that a new roll from the storage position is moved to the dispensing position, even though the roll with a limited diameter might not be completely depleted.

Optionally, the dispenser comprises a dispensing opening allowing dispensing from a roll arranged on a roll support of said two roll supports which is in a dispensing position.

Optionally, the dispenser comprises a cover protecting a roll arranged on a roll support of said two roll supports which is in the storage position.

Optionally, said cover defines said dispensing opening.

Optionally, movement of the dispenser from said second state to said third state implies moving said cover from a closed position to an open position.

Optionally, the dispenser is configured such that the roll supports can assume an intermediary position, wherein a roll support of said two roll supports which is in said intermediary position is located outside the housing and such that a transition of the dispenser from the second to the third state implies moving the dispenser to an intermediary state, wherein said first roll support is said intermediary outside said housing, wherein preferably the dispenser is configured such that a transition from the second state to the intermediary state is accomplished by action of gravity on the mandrel member.

Optionally, in said second state, said mandrel member is retained by a catch member, said catch member being mechanically coupled to said cover, such that opening of said cover to assume said open position implies release of said catch member allowing said mandrel member to fall downwards by action of gravity to said intermediary state.

Optionally, in said intermediary state, the orientation of the mandrel member is pivoted about the second roll support in relation to the orientation of the mandrel member in said second state Optionally, when the dispenser is in said intermediary state, the mandrel member is in a collapsed condition.

Optionally, in said intermediary state, the dispensing opening in the cover is adapted to the position of the mandrel member, such that the first roll support, which is in the intermediary position is accessible via the dispensing opening when the cover is in an open position.

Optionally, said mandrel member, in a collapsed condition, is pivotable from said intermediary state towards said third state by pivoting said first roll support through said dispensing opening.

Optionally, the dispenser is configured such that a transition from the intermediary state to the third state implies extending said mandrel member to its extended condition.

In a second aspect, the present disclosure according to the first aspect, comprising the steps of moving said mandrel member such that the dispenser is moved from said second state to said third state;

applying a new roll of material to said first roll support which is located in the refill position outside the housing, moving said mandrel member such that the dispenser is moved from said third state to said first state.

Optionally, the step of moving the mandrel member such that the dispenser is moved from said second state to said third state implies moving said mandrel member from said collapsed condition to said extended condition.

Optionally, the step of moving the mandrel member such that the dispenser is moved from said third state to said first state implies that the mandrel member is moved from a first configuration, in which said first roll support is one out of said two roll supports to a second configuration, in which said first roll support is the other out of said two roll supports.

Optionally, said step of moving the mandrel member such that the dispenser is moved from said third state to said first state implies pivoting said mandrel member about said second roll support.

In a third aspect, the present disclosure relates to a mandrel member comprising two roll supports, each roll support being configured for suspending a roll rotatably about a respective roll support axis, and a guide member along which the two roll supports are movable relative to each other such that the mandrel member displays an extended condition and a collapsed condition, wherein a minimum distance between the roll support axes of the two roll supports is shorter in said collapsed condition than in said extended condition.

Optionally, said minimum distance between the support axes of the two roll supports in said collapsed condition is less than 75% of the minimum distance between the two roll supports in said extended condition, preferably less than 65%, preferably less than 55%.

Optionally, said minimum distance between the support axes of the two roll supports in said collapsed condition is greater than 50% of the minimum distance between the roll supports in said extended condition, preferably 50-75%, more preferred 50-65%, most preferred 50-55%.

Optionally, the mandrel member defines a mandrel member centre, located centrally between the two roll supports when the mandrel member is in the extended condition, as seen in a plane perpendicular to the roll support axes. Preferably, the two roll supports are both symmetrically movable along the guide member with respect to the mandrel member centre.

Optionally, the collapsed condition of the mandrel member corresponds to the two roll supports being in either of two symmetrical arrangements with respect to the mandrel member centre.

Optionally, the guide member is symmetrical with respect to said mandrel member centre, as seen in a plane perpendicular to the roll support axes.

Optionally, the guide member defines a straight guide portion extending from one of said two roll supports to the other of said two roll supports when the mandrel member is in the extended condition, such that the first roll support and/or the second roll support are movable along a straight line between the extended condition and the collapsed condition.

Optionally, said guide member has a constant guiding length, and said two roll supports are movable along said guiding length.

Optionally, in said extended condition of the mandrel member, each of said two roll supports assumes a respective outermost position along said guide member, and, preferably, in said collapsed condition, one roll support of said two roll supports assumes its outermost position and the other roll support of said two roll supports assumes another position along the guide member than its outermost position. Optionally, in said collapsed condition, one roll support of said two roll supports assumes its outermost position and the other roll support of said two roll supports assumes a position wherein it abuts the one roll support.

Optionally, said first roll support comprises a first roll support portion defining said roll support axis for holding a roll of material, and a second roll support portion arranged to the guide member, and the second roll support comprises a first roll support portion defining said roll support axis for holding a roll of material, and a second roll support portion arranged to the guide member.

Optionally, said first roll support comprises a first roll support portion defining said roll support axis for holding a roll of material, and a second roll support portion, and the second roll support comprises a first roll support portion defining said roll support axis for holding a roll of material, and a second roll support portion wherein said second roll support portions of said first and/or second roll supports extend beyond said first roll support portions in the directions towards each other along said guide member, and wherein, when the mandrel member is in said collapsed condition, the second roll support portions of the first and second roll supports abut each other.

Optionally, the mandrel member comprises at least one retaining member between said guide member and said first and/or second roll supports for maintaining the mandrel member in a collapsed condition, preferably said guide member comprises said retaining member, most preferred said guide member comprises a protrusion forming said retaining member.

Features and advantages described in relation to any one of the aspects of the disclosure as described herein are equally applicable to the other aspects.

Moreover, a dispenser as described in the above, with any of the above-mentioned features or advantages, said dispenser comprising one or two rolls of absorbent paper web material is part of the present disclosure. In one option, the roll(s) may be comprising a core. In another option, the roll(s) may be coreless.

Further options and advantages of the devices and methods as disclosed herein are disclosed in the following description.

BRIEF DESCRIPTION OF THE DRAWINGS

Below follows a more detailed description of an example dispenser with reference to the appended drawings, wherein.

Similar reference numbers denote similar features throughout the description.

DETAILED DESCRIPTION OF PREFERRED EMBODIMENTS

Figure 1:
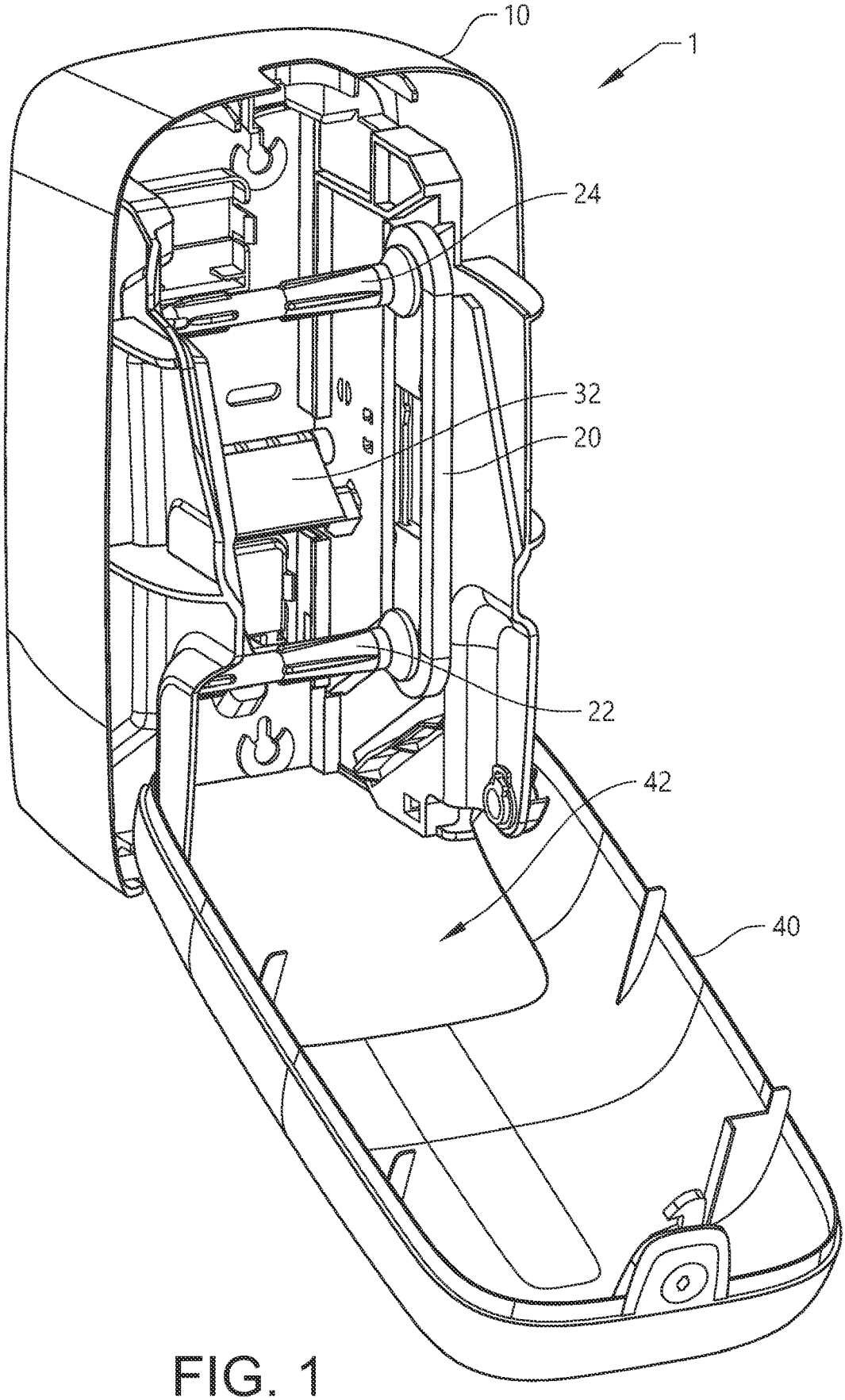
FIG. 1 is a perspective view of a variant of a dispenser when in a first state, and with the cover open for better visibility.

FIG. 1 is a perspective view of a variant of a dispenser 1 when in a first state, and with the cover 40 open for better visibility.

Figure 2A:
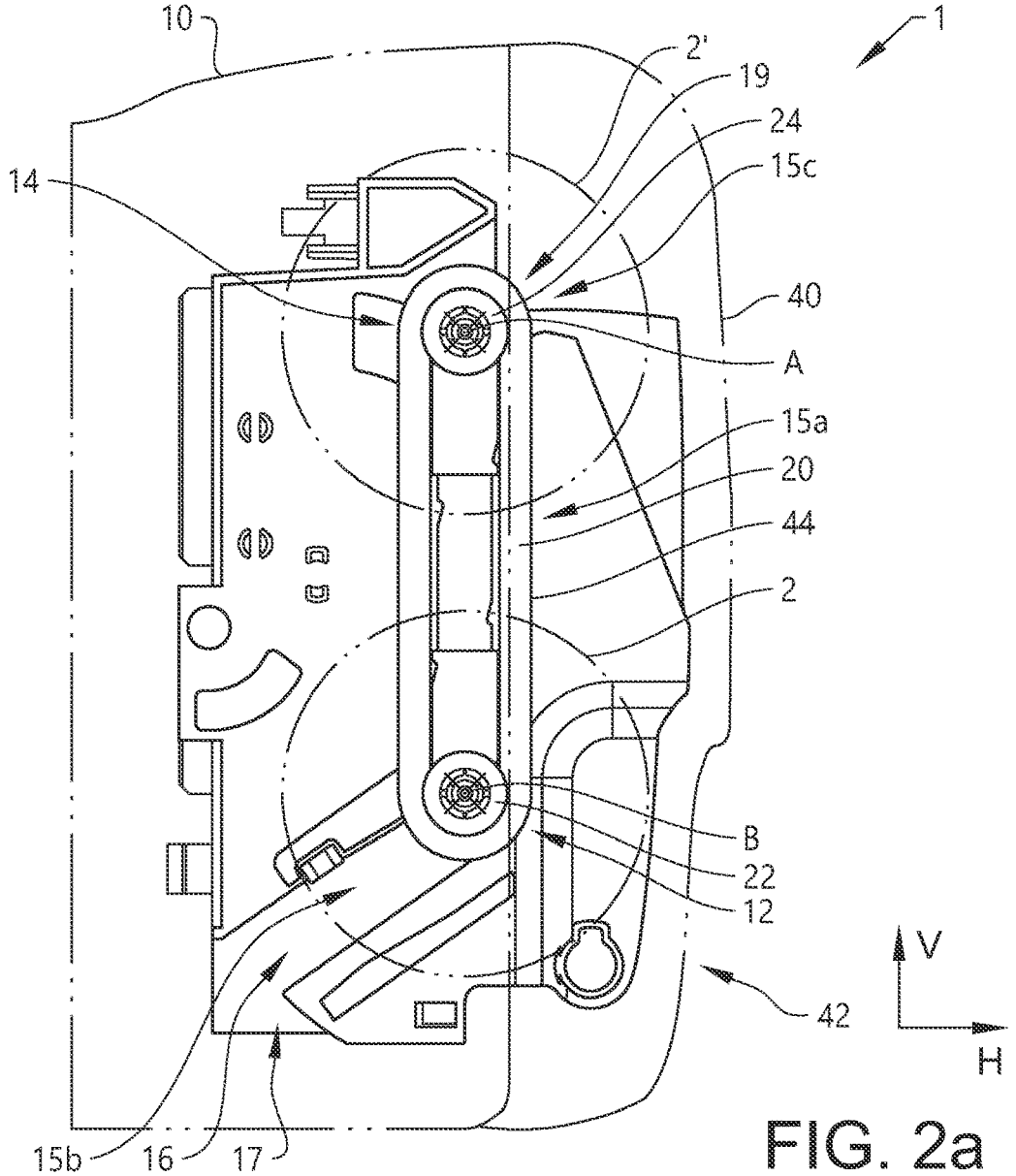
FIG. 2*a* illustrates a cross-sectional view of the dispenser of FIG. 1 when in a first state, and when the dispenser includes two rolls 2, 2' which are both new, substantially undepleted.

FIG. 2*a* illustrates a variant of a dispenser 1 for two rolls 2, 2' of web-shaped, rolled up material, e.g. absorbent paper.

The dispenser 1 comprises a housing 10 configured to house at least two rolls 2, 2'.

Optionally, and as in FIG. 2*a*, the dispenser 1 is configured to be arranged to a flat surface, e.g. a wall, extending generally along a vertical direction V. To this end, the dispenser may comprise suitable connectors e.g. apertures enabling the attachment of the dispenser 1 to a wall.

Figure 2B:
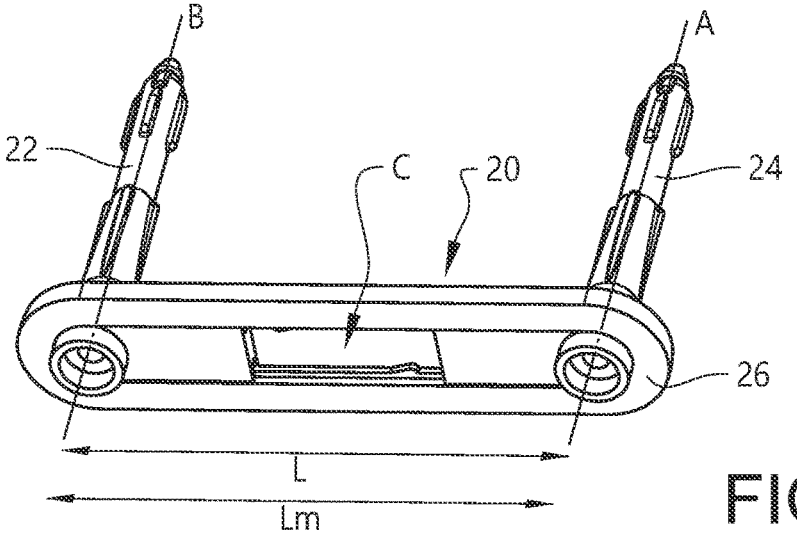
FIG. 2*b* illustrates a mandrel member of the dispenser in an extended condition.

FIG. 2*b* illustrates a mandrel member 20 comprising two roll supports 22, 24. The roll supports 22, 24 are each configured for suspending a roll of material rotatably about a respective roll support axis A, B.

FIG. 2*a* illustrates the dispenser 1 when in a first state. In this first state, a first roll support 22 of the roll supports 22, 24 of the mandrel member 20 is arranged in a dispensing position 12 provided by the dispenser 1. When the first roll support 22 is in the dispensing position 12, dispensing from a roll 2 of material arranged on the first roll support is allowed. To this end, the dispenser 1 may comprise a dispensing opening 42.

In the first state, a second roll support 24 of the roll supports 22, 24 of the mandrel member 20 is arranged in a storage position 14 provided by the dispenser 1. When the second roll support 24 is in the storage position 14, storage of a roll 2' arranged on the second roll support 24 is performed. With "storage" is indicated that dispensing from a roll arranged on a roll support which assumes the storage position is not enabled. Instead, the roll arranged on a roll support which assumes the storage position is to be stored for later use.

In the dispenser 1 of FIG. 2*a*, the dispenser 1 comprises a cover 40. The cover 40 forms a dispensing opening 42 through which dispensing of material from a roll 2 arranged on the first roll support 22 which assumes the dispensing position 12 is enabled. The cover 40 protects the roll 2' arranged on the second roll support 24 which is in the storage position 14.

As seen in FIG. 2*a* the dispenser 1 is configured such that the storage position 14 is vertically above said dispensing position 12. This arrangement allows for automatic movement of a roll 2' from the storage position 14 to a dispensing position 12, as will be described in more detail in the below.

Optionally, and as in FIG. 2*a*, the storage position 14 is arranged strictly vertically above the dispensing position 12. (i.e the storage position 14 is vertically separated from the dispensing position 12, but in the same horizontal position). This arrangement is advantageous for providing a dispenser 1 having outer dimensions which are relatively restricted along the horizontal dimension H. However, other arrangements, where the storage position 14 is arranged vertically above but horizontally separated from the dispensing position 12 are also conceivable.

The mandrel member 20 defines a guide member 26 along which the two roll supports 22, 24 are moveable, such that the mandrel member 20 displays an extended condition and a collapsed condition. A minimum distance L between the roll support axes A, B of the two roll supports 22, 24 is shorter in said collapsed condition than in said extended condition.

Figure 4A:
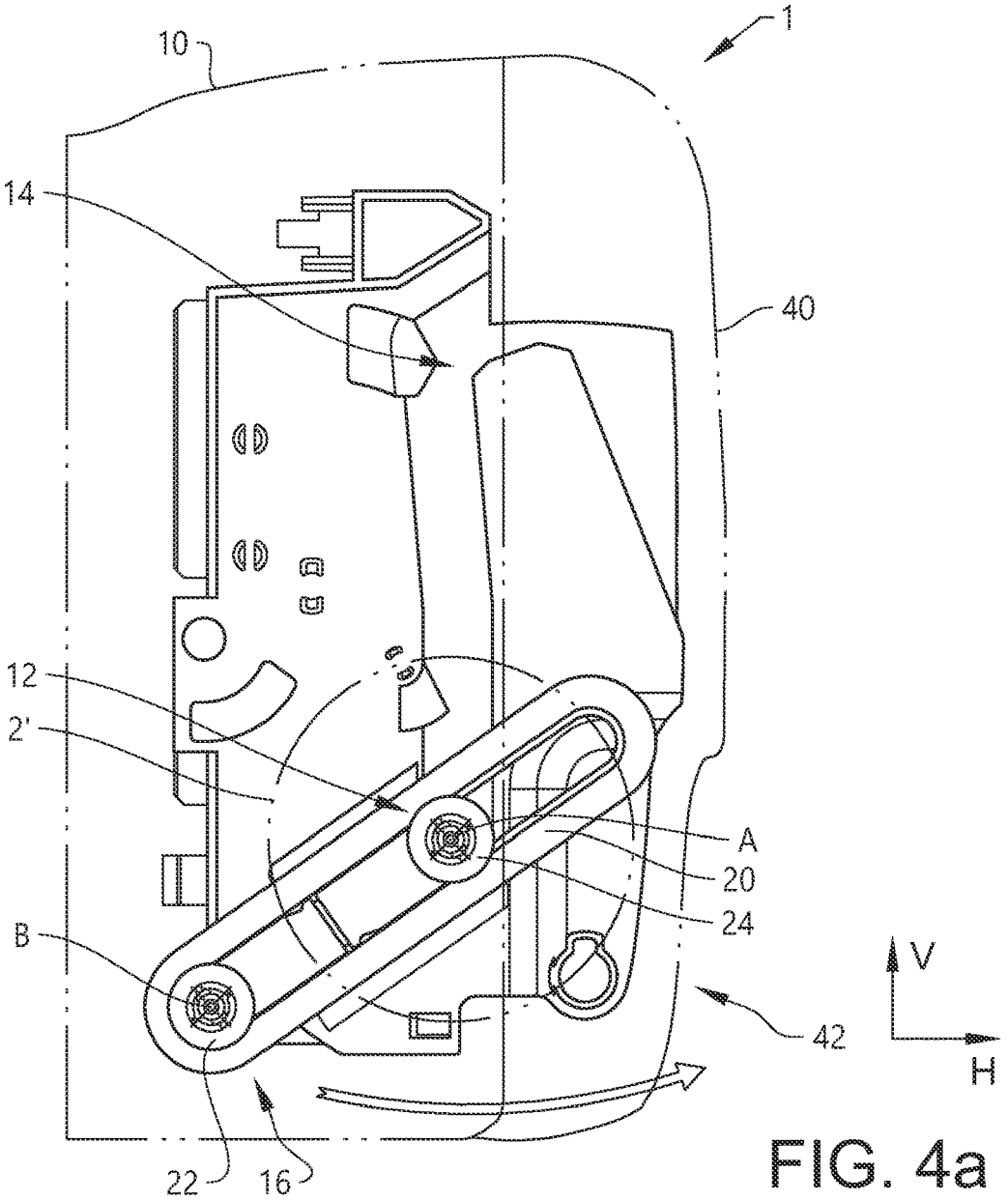
FIG. 4*a* illustrates the dispenser when in a second state with the second roll 2' in a dispensing position, and the first roll 2 in a depleted position.
Figure 4B:
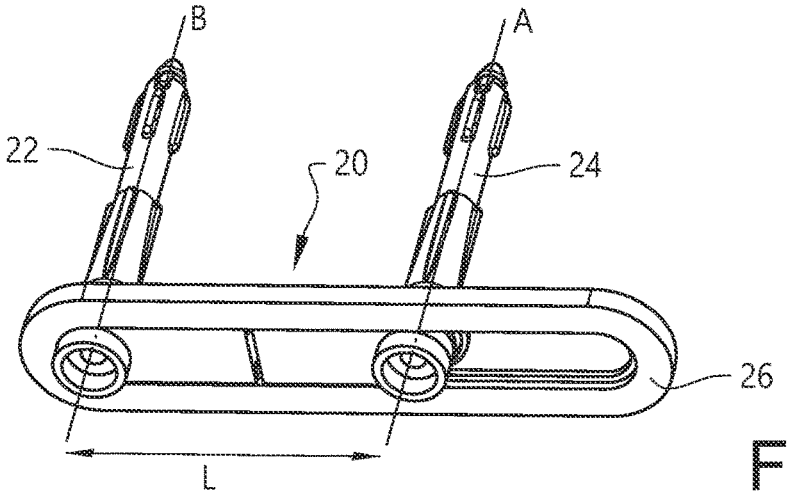
FIG. 4*b* illustrates the mandrel member of the dispenser in a collapsed condition.

FIG. 2*b* illustrates the mandrel member 20 in an extended condition, whereas FIG. 4*b* illustrates the mandrel member 20 in a collapsed condition. (See also FIGS. 6*a* and 6*b*.)

Optionally, the minimum distance L between the two roll support axes A, B of the two roll supports 22, 24 in the collapsed condition is less than 75% of the minimum distance L between the two roll support axes A, B of the two roll supports 22, 24 in the extended condition, preferably less than 65%, preferably less than 55%.

Optionally, said minimum distance L between the two roll support axes A, B of the two roll supports 22, 24 in said collapsed condition is greater then 50% of the minimum distance L between the two roll support axes A, B of the two roll supports 22, 24 in said extended condition, preferably 50-75%, more preferred 50-65%, most preferred 50-55%.

In the extended condition, the minimum distance L between the two roll support axes A, B may hence correspond to 2× the radius of a roll 2, plus some clearance. The minimum distance L between the two roll support axes A, B when the mandrel member 20 is in a collapsed condition may correspond to 1× the radius of a roll 2, plus some clearance.

As exemplified in the illustrated mandrel member 20, when in said extended condition, said mandrel member 20 is symmetrical about a centre C between said first roll support 22 and said second roll support 24.

Moreover, the first roll support 22 and the second roll support 24 are symmetrically movable along said guide member 26. In other words, the first roll support 22 may be moved towards the second roll support 24, or the second roll support 24 may be moved towards the first roll support 22, in a similar manner.

Optionally, and as in the illustrated mandrel member 20, the guide member 26 defines a straight guide portion along which said first roll support 22 and said second roll support 24 are movable.

Optionally, and in the illustrated mandrel member 20, the guide member 26 has a constant guiding length Lm, and said first roll support 22 and said second roll support 24 are movable along said guiding length Lm.

In the illustrated mandrel member 20, the guide member 26 forms a frame in which the first and second roll supports 22, 24 are enclosed. The first and second roll support 22, 24 are movable in a straight line along said frame between the extended condition and the collapsed condition.

It will be understood that in the extended condition, being the condition in which the minimum distance L between the first mandrel 22 and the second mandrel 24 is at its maximum, the two mandrels 22, 24 are maximally spaced apart. Hence, the two mandrels each assume an outermost end position along the guide member 26.

However, several collapsed conditions may be accomplished, since the two mandrels 22,24, may be brought together at several locations along the guide member 26.

In particular, one collapsed condition may be achieved wherein the first roll support 22 assumes its outermost end position along said guide member 26, and the second roll support 24 is located adjacent the first roll support 22.

Another collapsed condition may be achieved wherein the second roll support 24 assumes its outermost end position along said guide member 26, and said first roll support 22 is located adjacent said second roll support 24.

Figure 6A:
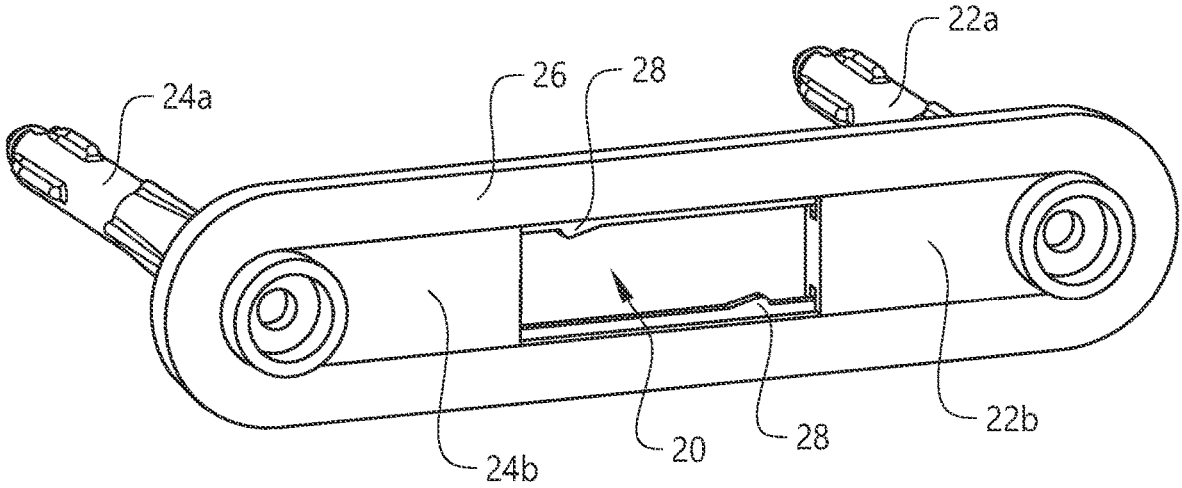
FIG. 6*a* illustrates the mandrel member when in an expanded condition.
Figure 6B:
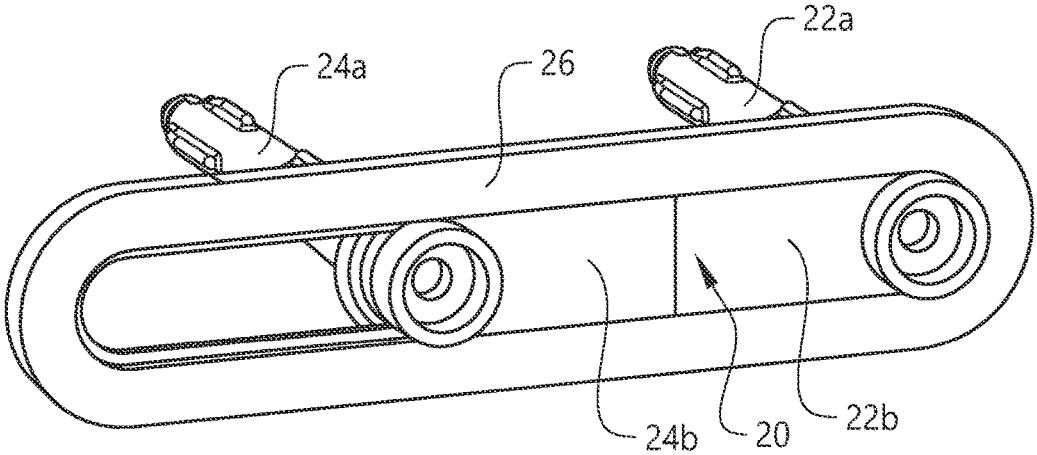
FIG. 6*b* illustrates the mandrel member when in a collapsed condition.

FIGS. 6*a* and 6*b* describe the mandrel member 20 in some more detail.

Optionally, and as in the illustrated mandrel member 20, the first roll support 22 comprises a first roll support portion 22*a* for holding a roll of material, and a second roll support portion 22*b* arranged to the guide member 26. Similarly, the second roll support 24 comprises a first roll support portion 24*a* for holding a roll of material, and a second roll support portion 24*b* arranged to the guide member 26. The first roll support portions 22*a*, 24*a* hence define the respective roll support axes A, B.

The second roll support portions 22*b*, 24*b* of said first and/or second roll supports 22, 24 have an extension towards each other, and a minimum distance L between said first and second roll supports 22, 24 when in a collapsed condition hence corresponds to the second roll support portions 22*b*, 24*b* of the first and second roll supports 22, 24 abutting each other.

In view of the above, by selecting the size and shape of the second roll support portions 22*b*, 24*b*, the minimum distance L between the first and second roll supports 22, 24 when the mandrel member 20 is in a collapsed condition may be selected.

Optionally, and as in the illustrated mandrel member, the mandrel member 20 comprises at least one retaining member 28 between said guide member 26 and said first and/or second roll supports 22, 24 for maintaining the mandrel member 20 in a collapsed condition.

In the illustrated mandrel member, two retaining members 28 are provided. Each retaining member 28 is provided to maintain the mandrel member 20 in one out of the two possible collapsed conditions, where one of the two roll supports 22, 24 is located in its outermost position along the guide member 26.

Optionally, and as in the illustrated mandrel member 20, the retaining member 28 may comprise a protrusion of the guide member 26, which protrusion forms a frictional lock with a corresponding part of the second roll support portions 22*b*, 24*b* of the roll supports 22, 24. In the illustrated embodiment, the second roll support portions 22*b*, 24*b* are each provided with grooves fitting with strips on the guide member 26 for accomplishing the movable arrangement of the roll supports 22, 24 to the guide member 26.

FIG. 4*a* illustrates a dispenser 1 in a second state. In this second state, the second roll support 24 is arranged in a dispensing position 12', and the first roll support 22 is arranged in another position than a dispensing position 12.

Optionally, and as in FIG. 4*a*, the first roll support 22 assumes a depleted position 16. The depleted position 16 is adapted for holding a roll support 22, 24 when the material of the roll 2, 2' carried by the roll support 22, 24 is depleted. Accordingly, the depleted position 16 may be confined in a relatively small space of the dispenser 1.

In contrast, the dispensing position 12 and the storage position 14 may each be confined in a space adapted to provide room for a roll 2, 2' of material provided on a roll support 22, 24 which assumes said dispensing position 12 or storage position 14, respectively.

Optionally, and as in the illustrated embodiment, the depleted position 16 may be arranged in the dispenser 1, at a location opposite the dispensing opening 42, e.g. with the depleted position 16 is located vertically below the dispensing position 12, and horizontally behind the dispensing position 12, as seen from the dispensing opening 42.

The dispensing position 12' assumed by the second roll support 24 when the dispenser is in the second state may be identical to the dispensing position 12 assumed by the first roll support 22 when the dispenser is in the first state. However, it is also conceivable that the dispensing position 12' assumed by the second roll support 24 when the dispenser is in the second state is another dispensing position 12.

It will be understood that the dispenser 1 may provide for more than one dispensing position in which dispensing of a roll of material arranged on the roll support in said position may take place. Preferably, the dispensing positions 12' are close to the dispensing position 12 as assumed by the first roll support 22 in the first state of the dispenser 12, allowing for dispensing of material via the same dispensing opening 42. However and as may be gleaned from FIG. 4, dispensing positions could be assumed close to the original dispensing position 12, e.g. slightly above the original dispensing position 12.

In the second state, as illustrated in FIG. 4*a*, the mandrel member 20 is in a collapsed state. That the distance L between the two roll supports 22, 24 is decreased allows for efficient moving away of the first roll support 22 (where the roll 2 is depleted) to a position other than a dispensing position inside the dispenser, i.e. to the depleted position 16 in the illustrated dispenser 1.

Optionally, and as in FIG. 4*a*, the orientation of the mandrel member 20 in the second state of the dispenser is pivoted in relation to the orientation of the mandrel member 20 in the first state (FIG. 2*a*). This allows for efficient use of space, and for example for the provision of the depleted position 16 towards the back of the dispenser 1, where the dispensing opening 42 is arranged at a front of the dispenser 1.

Optionally, and as in FIG. 4*a*, the depleted position 16 is vertically below the dispensing position (s) 12, 12'.

Optionally, and as in FIG. 4*a*, the location of the vertically uppermost portion of the mandrel member 20 in the second state of the dispenser is vertically below the location of the vertically uppermost portion of the mandrel member 20 in the first state of the dispenser. Similarly, optionally, the location of the vertically lowest portion of the mandrel member 20 in the second state of the dispenser 1 is vertically below the vertically lowest portion of the mandrel member 20 in the second state of the dispenser.

In other words, the mandrel member 20 as a whole is moved vertically downwards when the dispenser 1 moves from the first state to the second state.

Figure 3A:
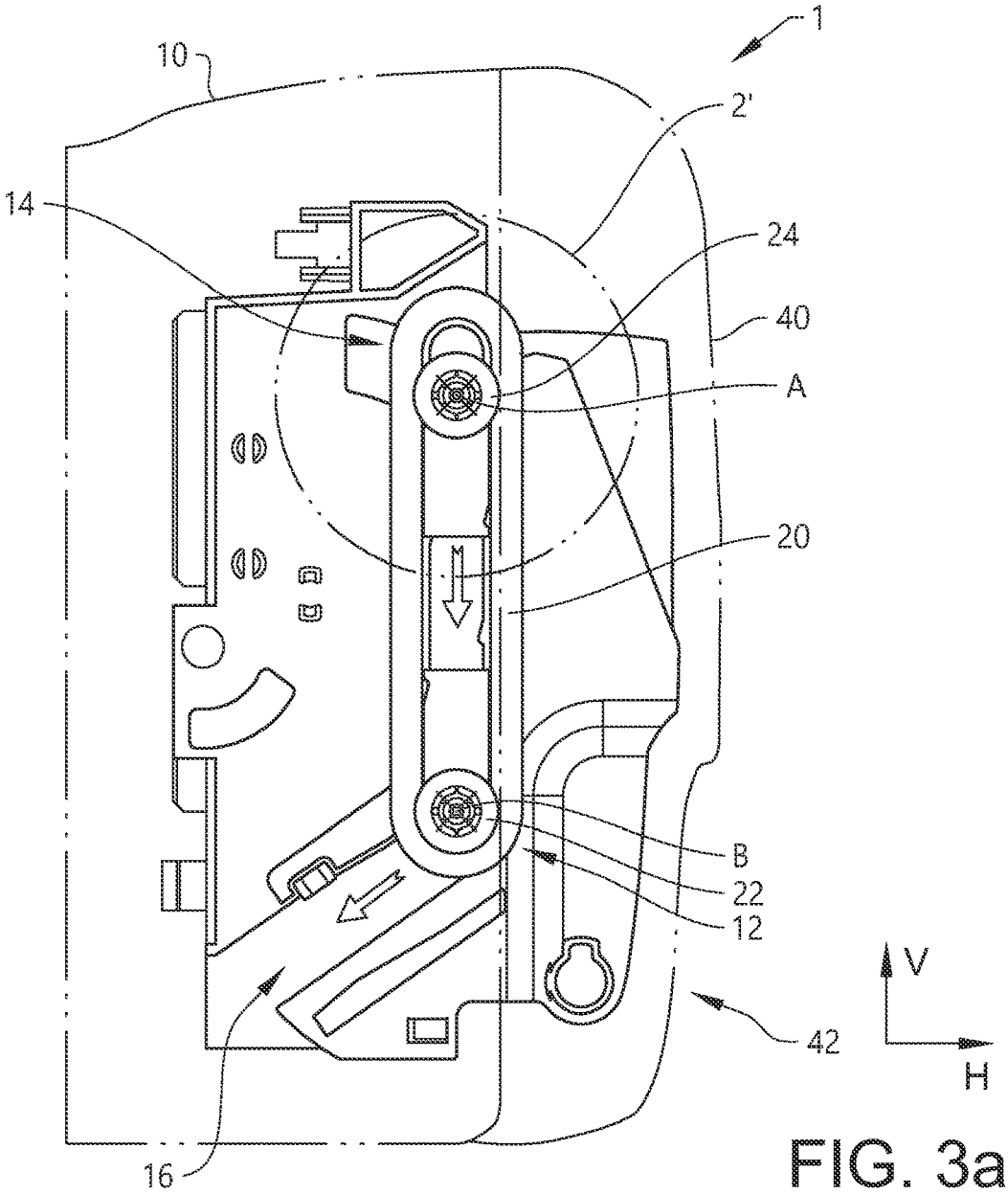
FIG. 3*a* illustrates the dispenser when being in a transitional position between the first state and a second state.
Figure 3B:
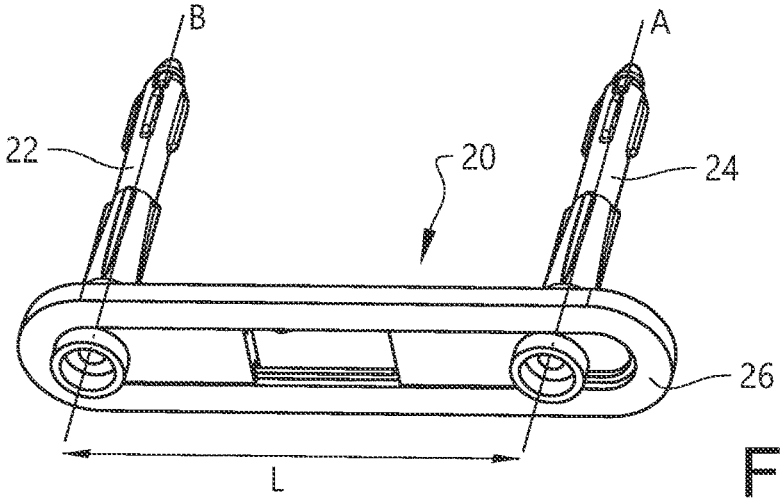
FIG. 3*b* illustrates the mandrel member of the dispenser in a transitional condition between the extended condition and a collapsed condition.

Optionally, and as in the dispenser of FIGS. 2 to 4, the transition of the dispenser from the first state (FIG. 2*a*) to the second state (FIG. 4*a*) is enabled by the action of gravity on a roll 2' positioned on the second roll support 24 when the dispenser is in the first state.

Optionally, and as in the illustrated dispenser, the dispenser 1 comprises a trigger arrangement 30 for actuating the transition of the dispenser from the first state to the second state.

Figure 8A:
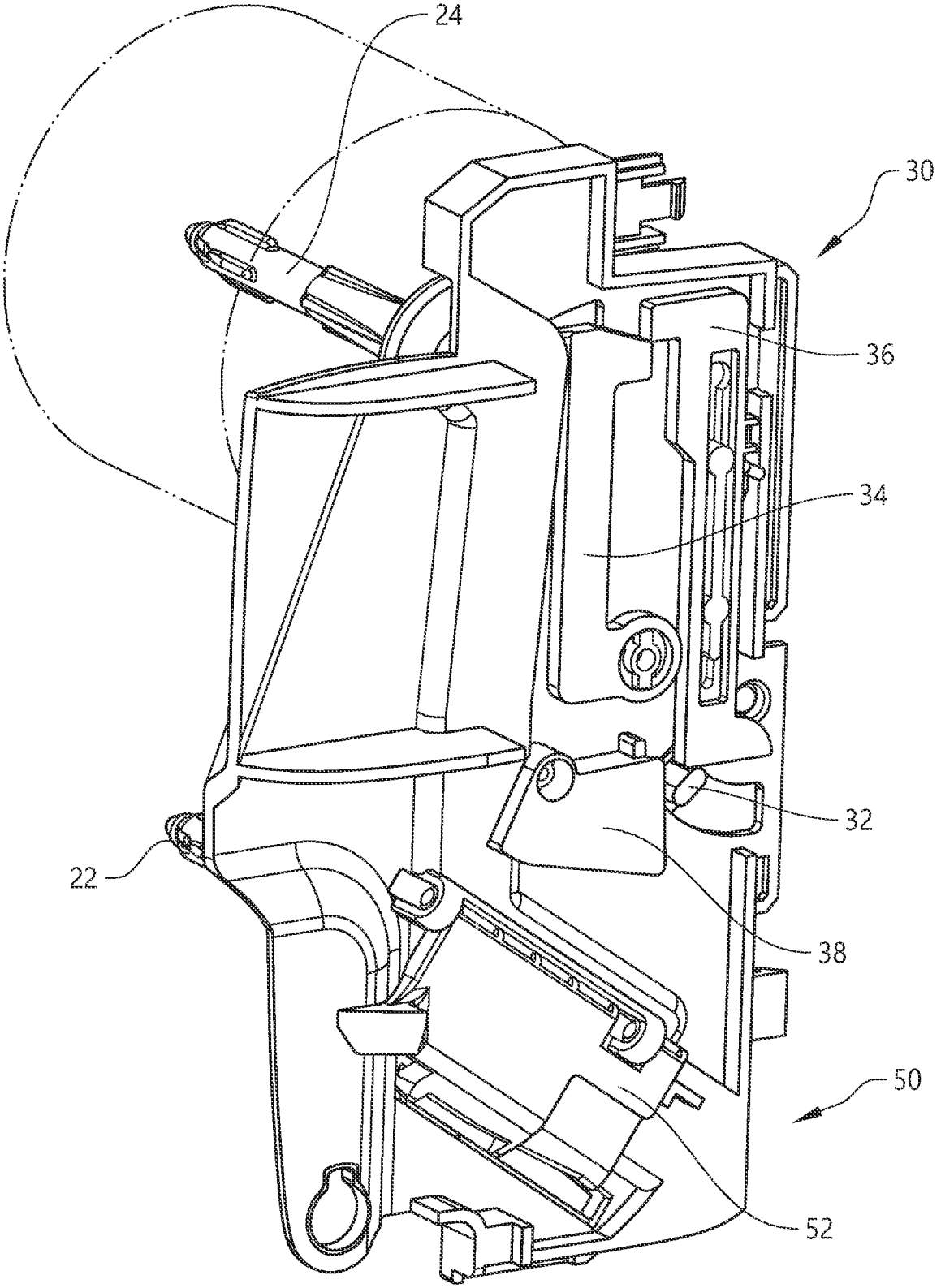
FIG. 8*a* is a view of the dispenser in which details of a trigger arrangement are visible.
Figure 8B:
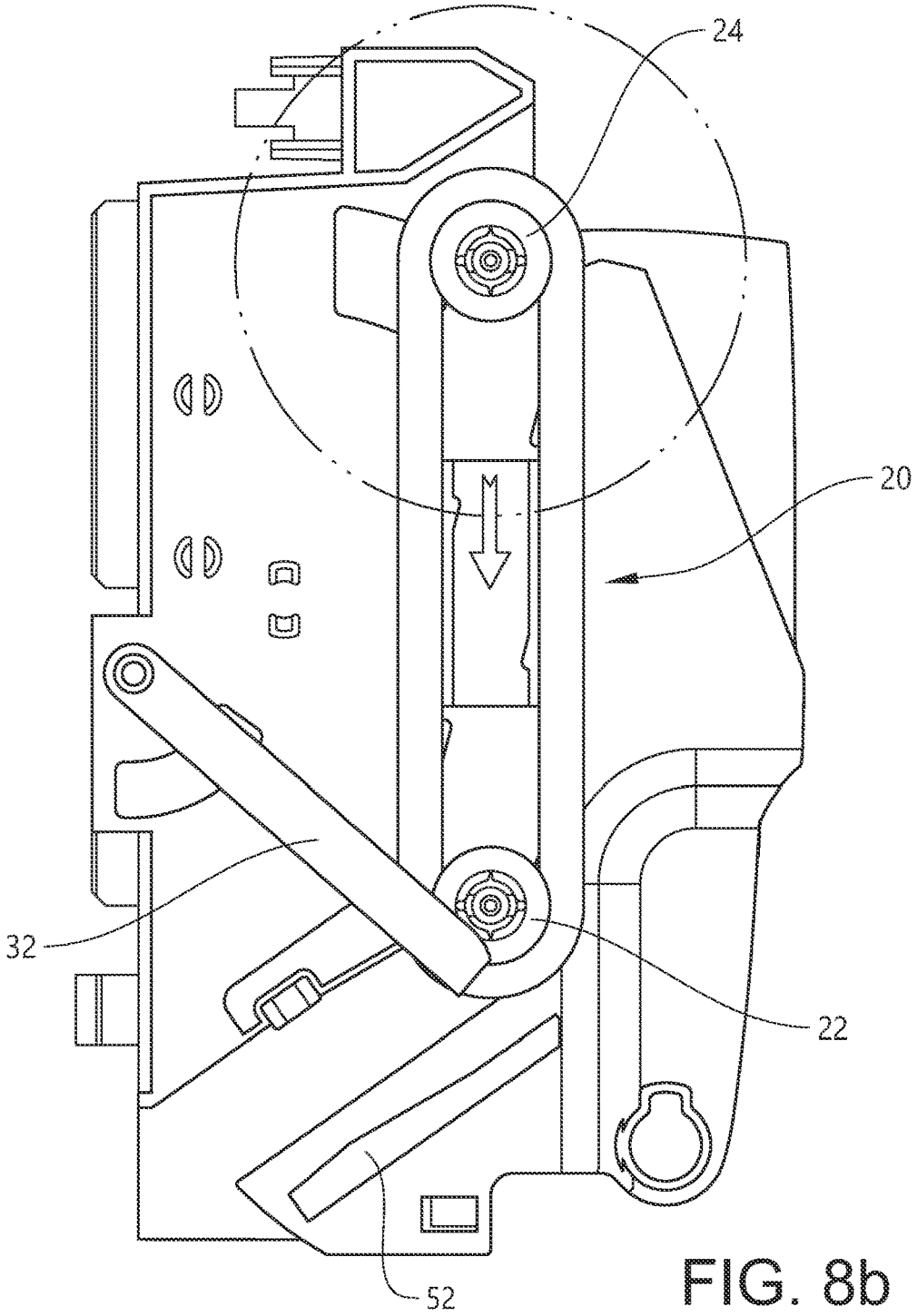
FIG. 8*b* is another view of the dispenser, in which details of a trigger arrangement and a hatch are visible.

The trigger arrangement 30 is described in more detail in FIGS. 8*a* and 8*b*. Another description of a trigger arrangement which may be used in variants of the dispenser is found in U.S. Pat. No. 7,967,235.

Optionally, and as in FIG. 8*a*, the trigger arrangement 30 comprises a sensing element 32 arranged in relation to a roll 2 positioned on the first roll support 22 when in the dispensing position 12. In the illustrated embodiment, the sensing element 32 is a mechanical sensing element in the form of an arm biased towards the dispensing position 12.

Optionally, and as in FIG. 8*a*, the trigger arrangement 30 comprises a hatch member 34 arranged to retain the second roll support 24 in the storage position 14 when the dispenser 1 is in its first state. The sensing element 32 and the hatch member 34 may be coupled so as to release the hatch member 34 upon the sensing element 32 sensing that the roll 2 on the first roll support is depleted.

With reference to FIG. 8*b*, the sensing element 32 may be biased towards the dispensing position 12 assumed by the first roll support 22. When the sensing element 32 is pivoted to a position adjacent the first roll support 22, indicating that the material on a roll 2 carried by the first roll support 22 is depleted, the movement of the sensing element 32 to this position is mechanically coupled via linkage 36 to the hatch member 34, so as to release the hatch member 34, allowing the second roll support 24 and the roll 2' positioned thereupon to fall downwards by action of gravity.

The downward fall of the second roll support 24 and its roll 2' simultaneously automatically compresses the mandrel member 20 from an extended condition to a collapsed condition.

As may be gleaned from FIGS. 2-4, the downward fall of the second roll support 24 and its roll 2' will also push the first roll support 22 away from the dispensing position 12, and in the illustrated dispenser, urge the first roll support 22 towards the depleted position 16, while pivoting the mandrel member 20.

As seen in FIG. 3*a*, which illustrates a transitional state between the first state and the second state, the second roll support 24 will initially fall vertically downwards under the action of gravity, causing the mandrel member 20 to move from an extended condition towards a collapsed condition. Once the second roll support 24 contacts the first roll support 22, energy from the falling second roll support 24 will be active to push the first roll support 22 away from the dispensing position 12 and towards the depleted position 16. The pushing of the first roll support 22 towards the depleted position 16 will cause the mandrel member 20 to pivot, due to the location of the depleted position 16 being inclined in relation to the vertical along which the second roll support 24 initially falls.

The roll supports 22, 24 will abut one another at their respective second portions 22*b*, 24*b*, which as mentioned in the above extend beyond the first portions 22*a*, 24*a* perpendicular to the roll support axes A, B. As may be understood from the illustrated embodiment, this enables the roll supports 22, 24 to abut one another even when the second roll support 24 carries a roll 2' having a radius which extension would hinder the first portions 22*a*, 24*a*, being the roll suspension portions, from contact.

Hence, the minimum distance L between the roll support axes A, B of the two roll supports 22, 24 in the collapsed condition may be determined by selecting appropriate extensions of the second portions 22*b*, 24*b*, so as to result in the desired minimum distance L between the roll support axes when the roll supports 22, 24 abut. In particular, the minimum distance L in the collapsed condition of the mandrel member 20 may be selected such that the radial thickness of a roll 2 which is to be housed in the dispenser 1 fits between the first portions 22*a*, 24*a* of the roll supports 22, 24.

As explained in the above, it is primarily intended that the trigger arrangement 30 including the sensing element 32 shall release the second roll support 24 when a roll 2 carried on the first roll support 22 is deemed to be depleted. However, a dispenser 1 with a mandrel member 20 as described herein also enables a by-pass function for moving an unused roll 2' from the storage position 14 to the dispensing position 12, when a relatively small amount of material remains on the roll 2 carried on the first roll support. This functionality may be useful e.g. in cases where the last amount of material on the roll 2 has become stuck or entangled on the roll, and hence the roll 2 cannot be completely depleted by normal dispensing of material.

The by-pass function is enabled by the mandrel member 20 being collapsible. As explained in the above in relation to FIGS. 8*a* and 8*b*, the trigger arrangement 30 is configured such that the hatch 34 releases the second roll support 24 when the sensing element 32 assumes a position adjacent the first roll support 22. In the dispenser of the figures, this corresponds to the sensing element 32 being pivoted a certain angular amount towards the first roll support 22.

As seen in FIG. 8*a*, a gate member 38 may be arranged so as to act as a barrier to the upward movement of the mandrel member 20. For example, the gate member 38 may be arranged at the guide arrangement 44 which will be described in some more detail below. The gate member 38 will allow the mandrel member 20 fall down through the guide arrangement 44, but the gate member 38 is arranged so as to prevent the first spindle 22 of the mandrel member 20 from being pulled upwards through the gate. Additionally, the gate member 38 may hinder the roll 20 which is in the dispensing position 12 from being lifted and thus collapsing the mandrel 20.

However, the gate member 38 may be configured to allow the roll 2 which is in the dispensing position 12 to be lifted slightly.

The gate member 38 may further be configured to allow a limited passage in an upward direction for a roll 2 provided on the first spindle 22. Thus, when the roll 2 has a limited, very small, diameter, ideally less than 25 mm diameter, the gate member 38 will allow the user to lift the dispensing roll 2 and cause a bypass.

Hence, when the roll 2 has a limited diameter, for example less than 25 mm diameter, a user may, by introducing his/her hand via the dispensing opening 42, reach the roll 2 arranged on the first roll support 22, and lift it vertically upwards without being hindered by the gate member 38 (which implies moving the mandrel member from an extended condition towards a collapsed condition). When the roll 2 arranged on the first roll support 22 is moved vertically upwards, the sensing element 32 is able to reach the position corresponding to a depleted roll on the first roll support 22. In the dispenser of the figures, this corresponds to the sensing element 32 being able to pivot all the way to the position adjacent the first roll support 22. When the sensing element 32 reaches the position corresponding to a depleted roll on the first roll support 22, the hatch 34 will be released, and the second roll support 24 carrying a second roll 2' will fall downwards by action of gravity.

Since the material remaining on the roll 2 of the first roll support 22 has a limited diameter, the vertical fall of the second roll support 24 will eventually result in the dispenser assuming the second position, as described in the above. The roll 2 with its remaining amount of material will, in the second state, be stored on the first roll support 22 in the depleted position.

It will be understood that when the dispenser 1 is used with rolls having a core, the core will necessarily follow the first roll support 22 to the depleted position.

Figure 5:
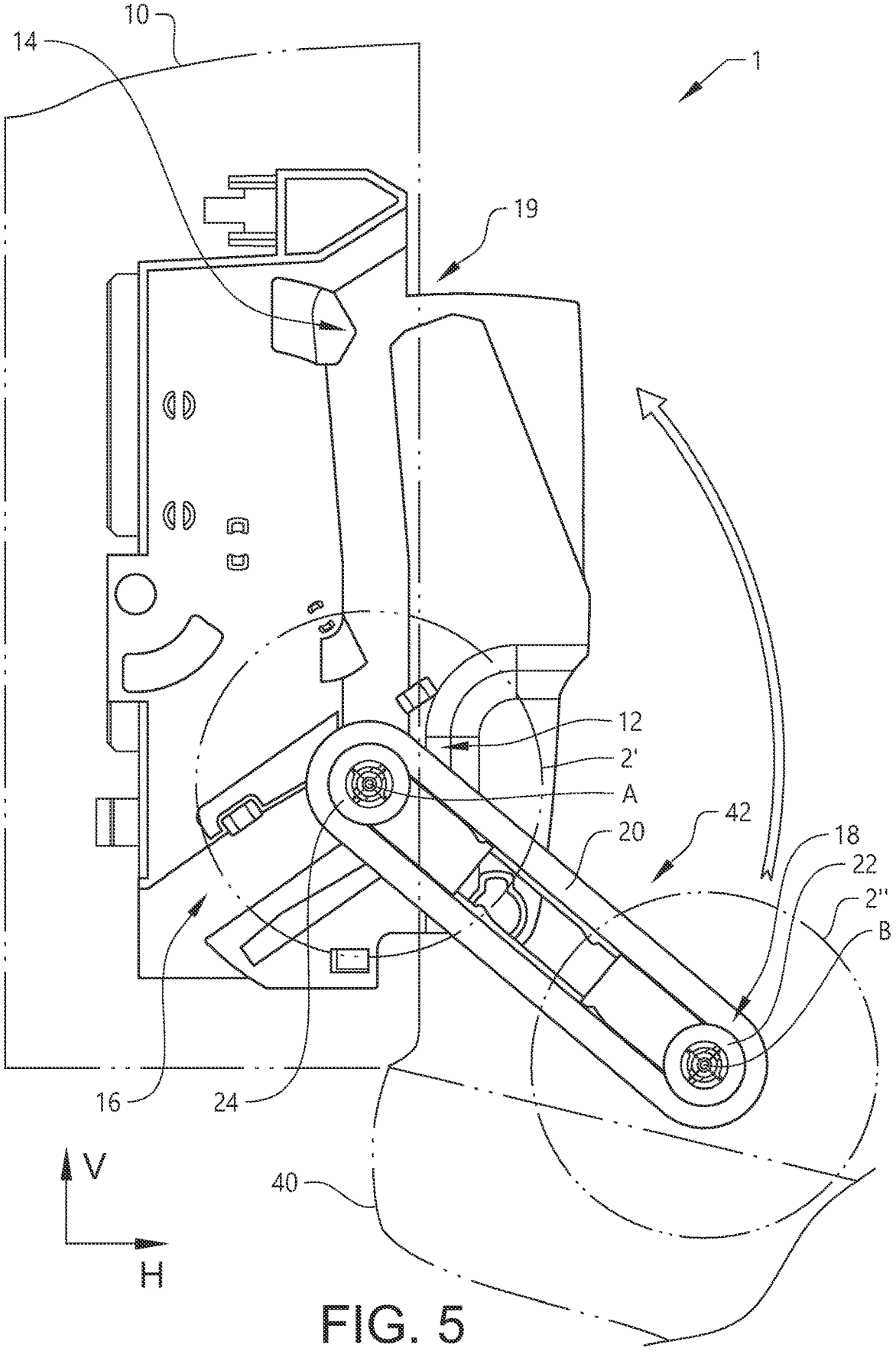
FIG. 5 illustrates the dispenser when in a third state, wherein a new roll 2" is arranged.

Optionally, and as illustrated in FIG. 5, the dispenser 1 is arranged to provide a third state in which the mandrel member 20 is located partly outside of the housing 1. In said third state, the mandrel member 20 is hence also located partly inside the housing 1. With the mandrel member 20 located partly outside the housing, the dispenser may provide a refill position 18 for a roll support, the refill position 18 being located outside of the housing 10. As such, the refill position 18 provides access to a first roll support 22, assuming said refill position 18, for arranging a new roll 2" of material on the first roll support 22.

For enabling the movement of the dispenser from the second state to the third state, at least the portion of the mandrel member 20 carrying the first roll support 22 may be moved out from the housing 10. Optionally, and as the illustrated dispenser 1, a removal opening 17 is arranged to allow removal of first roll support 22 out of the housing 10.

Optionally, and as in the illustrated dispenser 1, in the third state, the second roll support 24 remains in said dispensing position 12.

The movement of the mandrel member from the second state of the dispenser to the third state of the dispenser is indicated by an arrow in FIG. 4*a*.

Optionally, and as in the illustrated dispenser 1, the orientation of the mandrel member 20 when the dispenser 1 is in the third state (FIG. 5) is pivoted in relation to the orientation of the mandrel member 20 when the dispenser is in the second state (FIG. 4*a*). In particular, the mandrel member 20 is pivoted about the second roll support 24.

Optionally, and as in the illustrated dispenser 1, when in the third state, the mandrel member 20 is in an expanded condition. Accordingly, the distance L between the first roll support 22 and the second roll support 24 is long enough to allow for a new roll 2" of material to be arranged to the first roll support 22. Moreover, from the third state, the mandrel 20 being in an expanded condition means that it is ready for re-introduction into the dispenser 1 such that the dispenser 1 may reassume its first state, as will be described in the below.

Optionally, and as in the illustrated dispenser 1, the dispenser is moveable form the third state to the first state. In FIG. 5, this is accomplished by continued pivoting of the mandrel member 20 about the second roll support 24 in the direction of the arrow in the drawing. The housing 10 displays an insertion opening 19 through which the portion of the mandrel member 20 carrying the first roll support 22 may be inserted, so as to reassume the first state of the dispenser 1.

However, this movement from the third state to the first state implies that the mandrel member 20 is moved from a first configuration, in which said first roll support 22 is one of said two roll supports 22, 24, to a second configuration, in which said first roll support 22 is the other out of said two roll supports 22, 24.

This is to say that when the dispenser reassumes the first state from the third state, the set-up of the dispenser 1 is identical to that of the initially described first state (see FIG. 2*a*), with the exception that the mandrel member 20 is turned upside-down. This means that the roll support which was initially the "first roll support 22" and arranged in the dispensing position is now the "second roll support 24" and arranged in the storage position 14.

Hence, from the new first state, wherein the mandrel member 20 is in a second configuration with the "first roll support" 24 and the "second roll support" 22, the dispenser may now be moved from the first state, to the second state and again to the third state, as described in relation to FIGS. 2*a* to 5.

The dispenser 1 is hence movable from the first state to the second state, and from the second state to the third state while the mandrel member 20 stays in the same configuration, with the first roll support 22 being one and the same out of the two roll supports 22, 24. However, as described in the above, movement from the third state to the first state implies that the mandrel member 20 alters configuration, and the first roll support 22 or 24 in the third state becomes the second roll support 24 or 22 out of the two roll supports 22, 24 in the following first state.

Optionally, and in the illustrated dispenser 1, the housing 10 comprises a guide arrangement 44, arranged to guide the pivoting of the mandrel member 20 when the dispenser 1 transitions from said first state (FIG. 2*a*) to said second state (FIG. 4*a*), and/or from said second state (FIG. 4*a*) to said third state (FIG. 5), and/or from said third state (FIG. 5) to said first state (FIG. 2*a*).

Optionally, and in the illustrated dispenser 1 (see FIG. 2*a*), the guide arrangement 44 may comprise guiding means 15*a*, 15*b*, 15*c*. The guiding means 15*a*, 15*b*, 15*c* may be in the form of tracks in which the roll supports 22, 24 and/or the mandrel member 20 are movable.

A first portion 15*a* of the guide member may be arranged to extend between the storage position 14 and the dispensing position 12. A second portion 15*b* of the guide arrangement 44 may be arranged to extend between the storage position 14 and the dispensing position 12. Optionally, the guide member 44 may extend from the dispensing position 12 to the removal opening 17.

A third portion 15*c* of the guide member 14 may be arranged to extend between the insertion opening 19 to the storage position 16.

Accordingly, and as in the illustrated dispenser 1, the guide member 44 may form a continuous guiding path from the insertion opening 19 to the storage position 14, from the storage position 14 to the dispensing position 12, from the dispensing position 12 to the depleted position 16, and from the depleted position 16 to the removal opening 17.

Optionally, and as in the illustrated dispenser 1, the insertion opening 19 and/or the removal opening 17, preferably both, may be covered by a cover 40 when the dispenser 1 is in use.

Optionally, and as in the illustrated dispenser 1, the cover 40 may be moved from a closed position to an open position, wherein, when the cover 40 is in said open position, movement of the dispenser 1 from the second state to the third state is enabled.

Optionally, the transition of the dispenser 1 from the second state to the third state implies transition to an intermediary state, wherein the first roll support 22 is in a position outside the housing 1. Optionally, and as will be described in relation to the illustrated dispenser 1, the movement from the second state to the intermediary state may be accomplished by action of gravity on the mandrel member 20.

As such, the intermediary state may be reached by the mandrel member 20 being allowed to fall downwards under the action of gravity from its position when the dispenser 1 is in its second state.

Figure 7A:
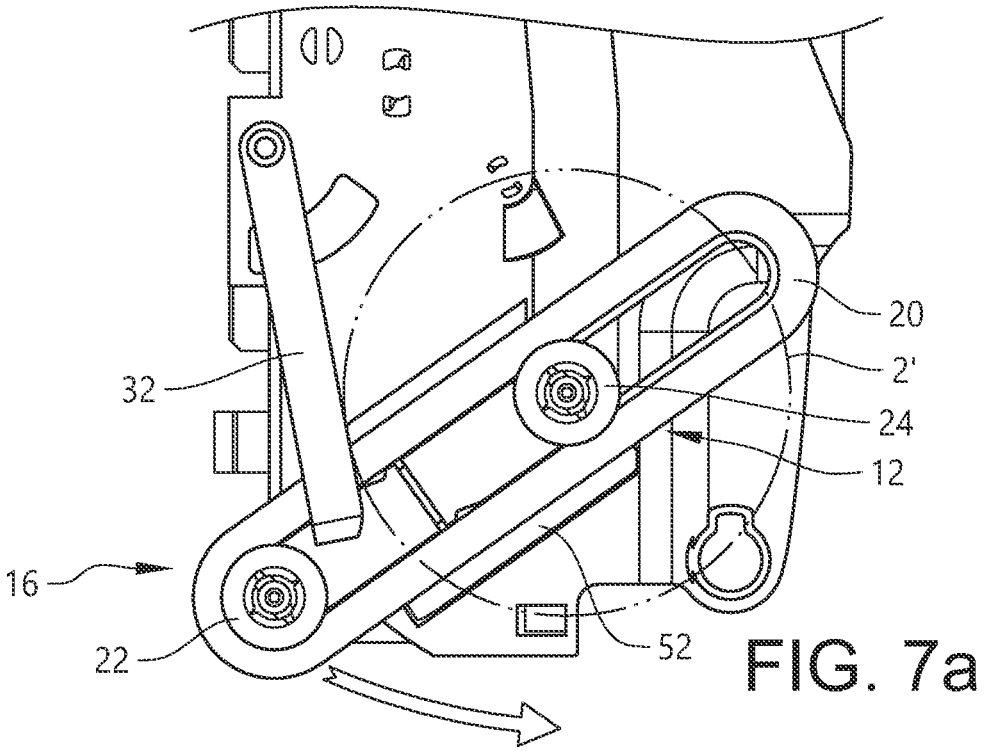
FIG. 7*a* illustrates the lower portion of the dispenser, which is in a the second state as in FIG. 5, with a second roll on a second roll support in a dispensing position and a first roll support in a depleted position in the housing, and the mandrel being in a collapsed condition.

FIG. 7*a* illustrates a portion of the dispenser 1 when in a second state.

The mandrel member 20 is retained by a catch member 50, in the form of a catch 52, so as hinder the first roll support 22 and a portion of the mandrel member 20 from falling out of the housing 10 via the removal opening 17.

Optionally, the catch member 50 may be mechanically coupled to the cover 40, such that opening of the cover 40 to assume an open position implies release of the catch member 50 allowing the mandrel member to fall downwards by action of gravity to reach the intermediary state.

Figure 7B:
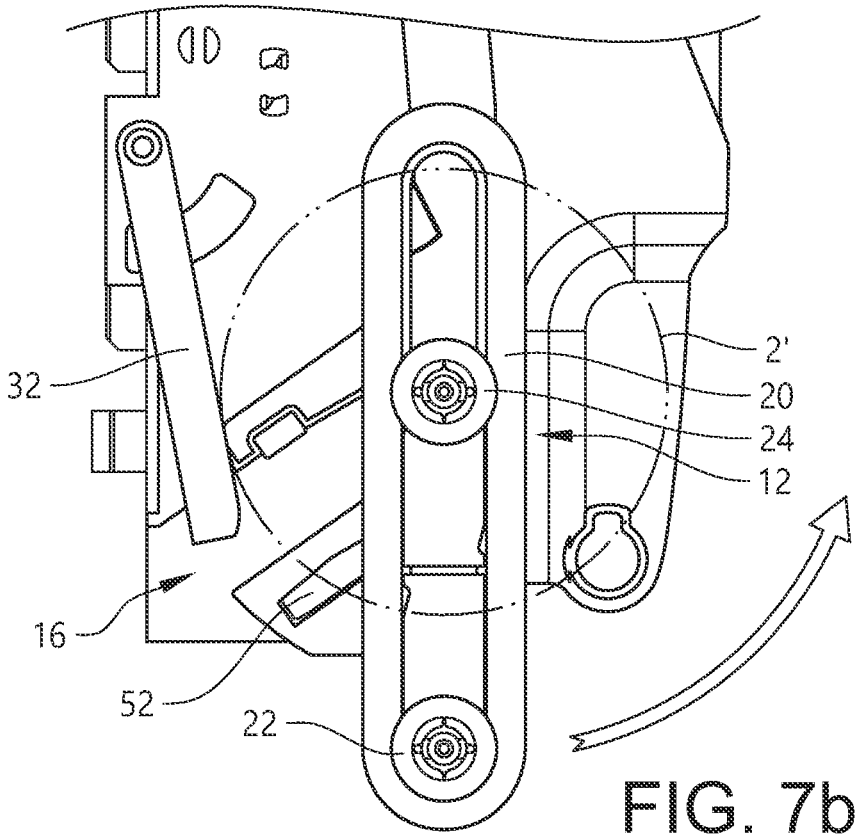
FIG. 7*b* illustrates the lower portion of the dispenser when in an intermediary state to which the dispenser is brought from the second state of FIG. 7*a*, in said intermediary state a first roll support is located outside of the housing and the mandrel is in a collapsed condition.
Figure 7C:
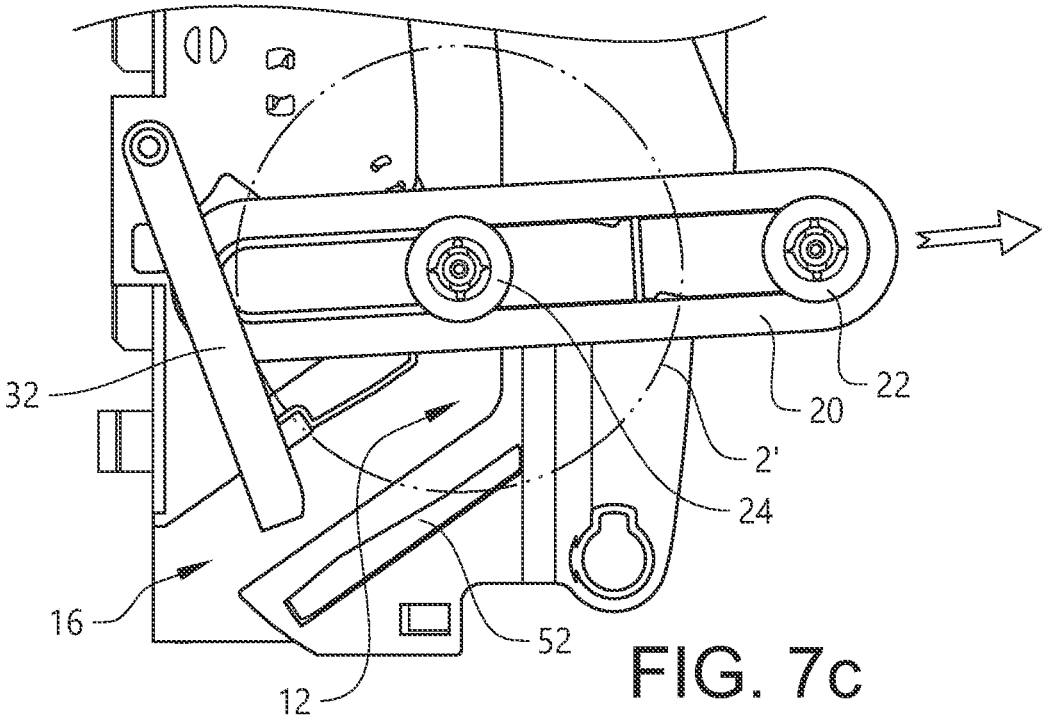
FIG. 7*c* illustrates the lower portion of the dispenser when in a transitional state, to which the dispenser is brought from the intermediary state of FIG. 7*b*, in said transitional state a first roll support is located outside of the housing and the mandrel is in a collapsed condition.

FIG. 7*b* illustrates an intermediary state of the dispenser 1. The catch member 50 in the form of a catch 52 being released, meaning that the lowermost portion of the mandrel member 20, carrying the first roll support 22 falls vertically downwards out from the housing 10 via the removal opening 17. Moreover, the mandrel member 20 may pivot under the action of gravity, so as to pivot about the second roll support 24, which remains in the dispensing position 12. As a result, the first roll support 22, in the intermediary position, is located generally strictly vertically below the second roll support 24.

Optionally, and in the illustrated dispenser 1, the mandrel member 20 is in its collapsed condition when the dispenser 1 is in the intermediary state.

Optionally, and in the illustrated dispenser 1, the dispensing opening 42 of the cover 40 when open is adapted to the position of the mandrel member 20 in the intermediary state of the dispenser 1 such that, when the dispenser is in the intermediary state, the first roll support 22 is accessible via the dispensing opening 42 of the open cover 40.

Figure 7D:
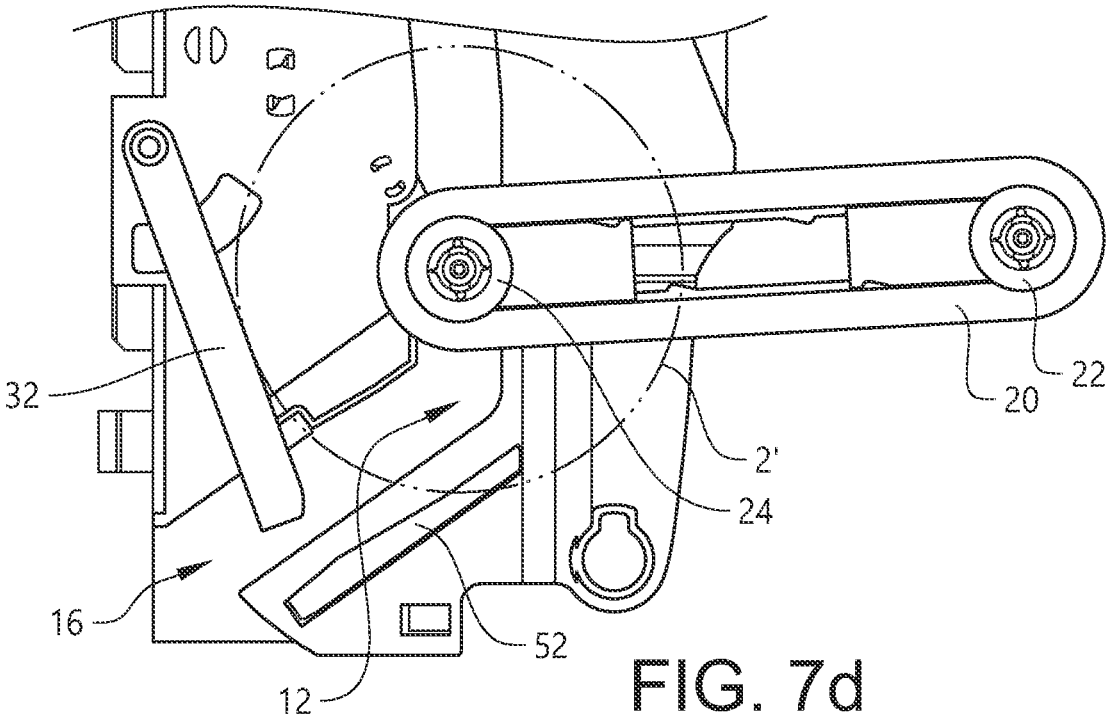
FIG. 7*d* illustrates the lower portion of the dispenser when in a third state, to which the dispenser is brought from the intermediary state of FIG. 7*b*, wherein said mandrel is in an expanded condition, and the first roll support is located outside of the housing and in a position allowing for placement of a new roll of material onto the first roll support.
Figure 7E:
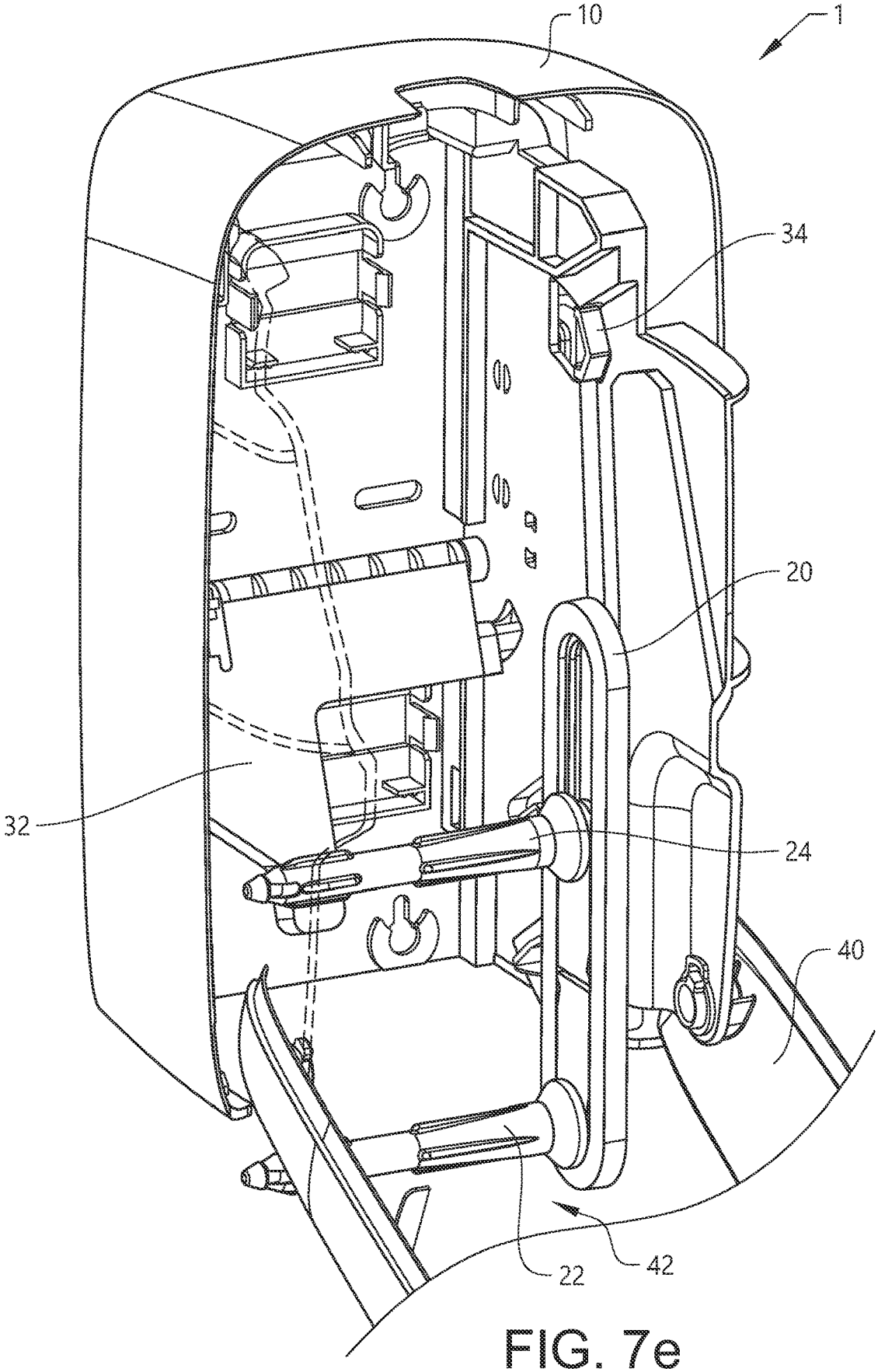
FIG. 7*e* is a perspective view of the dispenser when in the intermediary state of FIG. 7*b;*

FIG. 7*e* illustrates the intermediary state of the example dispenser 1 with the cover 40 in an open position. The cover 40 is hinged to the housing 10 along a lower front end thereof. When the cover 40 is in its open position, the dispensing opening 42 is located such that the first roll support 22 may be reached via the dispensing opening 42.

Accordingly, a user may reach the first roll support 22 and pull it towards him/herself so as to pivot the mandrel member 20 towards the position assumed in the third state of the dispenser. Also, the manual force from pulling the first roll support 22 may be used to bring the mandrel member 20 from the collapsed condition of the intermediary state (FIG. 7*e*, FIG. 7*b*) to the extended condition in the third state (FIG. 7*d*). For example, the pulling of the first roll support 22 may overcome the frictional engagement provided by the protrusion 28 of the mandrel member 20, serving to maintain the mandrel member 20 in a collapsed condition during transition of the dispenser from the second to the intermediary state.

When it is desired to load the dispenser with a new roll of material, the cover 40 may initially be opened so as enable moving of the mandrel member 20 and in particular of the first roll support 22 away from the depleted position 16 and out of the dispenser housing 10.

Figure 9:
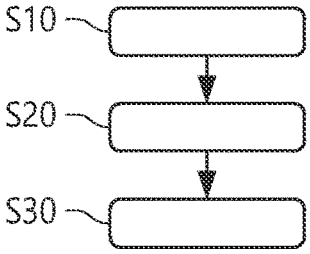
FIG. 9 is a flow chart illustrating a method for replenishing a dispenser.

FIG. 9 is a flow chart indicating the steps of a method for replenishing a of a dispenser as disclosed herein, for example a dispenser 1 as exemplified in the enclosed drawings.

As such, the method comprises the steps of

S10: moving said mandrel member 20 such that the dispenser 10 is moved from said second state to said third state;

S20: applying a new roll 2" of material to said first roll support 22 which is located in the refill position 18 outside the housing, S30: Moving said mandrel member 20 from said third state to said first state.

Optionally, the step S20 of moving said mandrel member 20 from said second state to said third state implies moving said mandrel member 20 from said collapsed condition to said extended condition.

Optionally, the step S30 of moving the mandrel member 20 from said third state to said first state S30 implies that the mandrel member is moved from a first configuration, in which said first roll support 22 is one out of said two roll supports 22, 24 to a second configuration, in which said first roll support 22 is the other out of said two roll supports.

Optionally, the step S30 of moving the mandrel member 20 from said third state to said first state implies pivoting said mandrel member 20 about said second roll support 24.

Other features and advantages applicable to the method have been described in the above in relation to the description of the dispenser. It will be understood that such features and advantages may be combined with the method as outlined in the above. Although the description in the above is made with relation to an example variant of a dispenser, it will be realised that the features described may be used in other variants of dispensers to provide similar advantages.

Numerous variants and options of the dispensers, mandrel members and methods disclosed herein will be conceivable by the person skilled in the art.

The invention claimed is:

1. A dispenser arranged for housing at least two rolls of rolled up absorbent paper material, the dispenser comprising:

a mandrel member comprising two roll supports, each roll support being configured for suspending a roll rotatably about a roll support axis; and a housing, the dispenser being configured such that the roll supports can assume the following positions relative to the housing:

at least one dispensing position for one of said two roll supports, and a storage position for another of said two roll supports, the dispenser being configured for allowing dispensing from a roll of material arranged on the one roll support of said two roll supports which is in said dispensing position and for storage of a roll arranged on the another roll support of said two roll supports which is in said storage position;

said dispenser being configured to provide:

a first state, wherein a first roll support of said roll supports is in said dispensing position and a second roll support of said roll supports is in said storage position, and a second state, wherein said second roll support is in a dispensing position, and said first roll support is in another position than said storage position, wherein the mandrel member defines a guide member along which the two roll supports are movable relative to each other such that the mandrel member displays an extended condition and a collapsed condition, wherein a minimum distance between the roll support axes of the two roll supports is shorter in said collapsed condition than in said extended condition, and in the first state, the mandrel member is in said extended condition, and in the second state, the mandrel member is in said collapsed condition.

2. The dispenser according to claim 1, the dispenser being configured such that the roll supports further can assume the following position relative to the housing: at least one depleted position for a roll support of said two roll supports, the dispenser being configured for holding said roll support in said depleted position when the material of the roll carried by said roll support is depleted, and wherein, in said second state of said dispenser, said first roll support is in said depleted position.

3. The dispenser according to claim 1, wherein, in the second state of said dispenser, the second roll support is in a dispensing position deviating from the dispensing position assumed by the first roll support in said first state by less than 20% of a length between the first roll support and the second roll support when the dispenser is in said first state, preferably deviating from the dispensing position assumed by the first roll support in said first state by less than 10% of said length.

4. The dispenser according to claim 1, wherein, in the second state of said dispenser, the second roll support is in the same dispensing position as assumed by the first roll support in the first state of said dispenser.

5. The dispenser according to claim 1, wherein the orientation of the mandrel member in said second state of the dispenser is pivoted in relation to the orientation of the mandrel member in the first state.

6. The dispenser according to claim 1, wherein the dispenser is configured such that the storage position is vertically above said dispensing position, and the location of the vertically uppermost portion of the mandrel member in said second state of the dispenser is vertically below the location of the vertically uppermost portion of the mandrel member in said first state of the dispenser, or the location of the vertically lowest portion of the mandrel member in said second state of the dispenser is vertically below the vertically lowest portion of the mandrel member in said first state of the dispenser.

7. The dispenser according to claim 1, wherein the dispenser is configured such that the roll supports further can assume the following position relative to the housing: a refill position located outside of said housing, wherein to provide said refill position, a part of said mandrel member is located outside of said housing, wherein the dispenser being configured for providing access to a roll support of said two roll supports which is in said refill position for arranging a new roll of material on said roll support, and said dispenser being configured to provide a third state, wherein said first roll support of said roll supports is in said refill position, and wherein preferably said second roll support is in a dispensing position.

8. The dispenser according to claim 1, wherein said minimum distance between the roll support axes of the two roll supports in said collapsed condition is less than 75% of the distance between the roll support axes of the two roll supports in said extended condition.

9. The dispenser according to claim 1, wherein the collapsed condition of the mandrel member corresponds to the two roll supports being in either of two symmetrical arrangements with respect to the mandrel member centre.

10. The dispenser according to claim 9, wherein, said guide member is symmetrical with respect to said mandrel member centre, as seen in a plane perpendicular to the roll support axes.

11. The dispenser according to claim 1, wherein said guide member defines a straight guide portion extending from one out of said two roll supports to the other out of said two roll supports when the mandrel member is in the extended condition, such that the first roll support and/or said second roll support are movable along a straight line between the extended condition and the collapsed condition.

12. The dispenser according to claim 1, wherein said guide member has a constant guiding length, and said two roll supports are movable along said guiding length.

13. The dispenser according to claim 1, wherein said first roll support comprises a first roll support portion defining said roll support axis (A) for holding a roll of material, and a second roll support portion, and the second roll support comprises a first roll support portion defining said roll support axis (B) for holding a roll of material, and a second roll support portion wherein said second roll support portions of said first and/or second roll supports extend beyond said first roll support portions in the directions towards each other along said guide member, and wherein, when the mandrel member is in said collapsed condition, the second roll support portions of the first and second roll supports abut each other.

14. The dispenser according to claim 1, wherein the dispenser is configured such that a transition of the dispenser from said first state to said second state implies transferring said mandrel member from said extended condition to said compressed condition by action of gravity on a roll positioned on said second roll support.

15. The dispenser according to claim 14, wherein the dispenser comprises a trigger arrangement for actuating said transition of the dispenser from said first state to said second state.

16. The dispenser according to claim 1, wherein the dispenser comprises a dispensing opening allowing dispensing from a roll arranged on a roll support of said two roll supports which is in a dispensing position.

17. The dispenser according to claim 1, wherein the dispenser comprises a cover protecting a roll arranged on a roll support of said two roll supports which is in the storage position.

18. The dispenser according to claim 7, wherein the dispenser is configured such that the roll supports can assume an intermediary position, wherein a roll support of said two roll supports which is in said intermediary position is located outside the housing and such that a transition of the dispenser from the second to the third state implies moving the dispenser to an intermediary state, wherein said first roll support is in said intermediary position outside said housing, wherein the dispenser is configured such that transition from the second state to the intermediary state is accomplished by action of gravity on the mandrel member.

19. The dispenser according to claim 18 wherein, in said intermediary state, the dispensing opening in the cover is adapted to the position of the mandrel member, such that the first roll support which is in the intermediary position is accessible via the dispensing opening when the cover is in an open position.

20. A method for replenishing a dispenser according to claim 1, comprising the steps of moving said mandrel member such that the dispenser is moved from said second state to said third state;

Applying a new roll of material to said first roll support which is located in the refill position outside the housing, Moving said mandrel member such that the dispenser is moved from said third state to said first state.

21. The method according to claim 20, wherein the step of moving said mandrel member such that the dispenser is moved from said second state to said third state implies moving said mandrel member from said collapsed condition to said extended condition.

22. The method according to claim 20, wherein said step of moving the mandrel member such that the dispenser is moved from said third state to said first state implies that the mandrel member is moved from a first configuration, in which said first roll support is one out of said two roll supports to a second configuration, in which said first roll support is the other out of said two roll supports.

23. The method according to claim 20, wherein said step of moving the mandrel member such that the dispenser is moved from said third state to said first state implies pivoting said mandrel member about said second roll support.

24. A mandrel member comprising two roll supports, each roll support being configured for suspending a roll rotatably about a respective roll support axis and a guide member along which the two roll supports are movable relative to each other such that the mandrel member displays an extended condition and a collapsed condition, wherein a minimum distance between the roll support axes of the two roll supports is shorter in said collapsed condition than in said extended condition.

25. The mandrel member according to claim 24, wherein said minimum distance between the roll support axes of the two roll supports in said collapsed condition is less than 75% of the distance between the roll support axes of the two roll supports in said extended condition.

26. The mandrel member according to claim 24, wherein said mandrel member defines a mandrel member centre, located centrally between said two roll supports when the mandrel member is in its extended condition, as seen in a plane perpendicular to the roll support axes.

27. The mandrel member according to claim 24, wherein said guide member defines a straight guide portion extending from one of said two roll supports to the other of said two roll supports when the mandrel member is in the extended condition, such that the first roll support or said second roll support are movable along a straight line between the extended condition and the collapsed condition.

28. The mandrel member according to claim 24, wherein, in said extended condition of the mandrel member, each of said two roll supports assumes a respective outermost position along said guide member, and, in said collapsed condition, one roll support of said two roll supports assumes its outermost position and the other roll support of said two roll supports assumes another position along the guide member than its outermost position.

29. The mandrel member according to claim 24, wherein said first roll support comprises a first roll support portion defining said roll support axis for holding a roll of material, and a second roll support portion, and the second roll support comprises a first roll support portion defining said roll support axis for holding a roll of material, and a second roll support portion wherein said second roll support portions of said first and/or second roll supports extend beyond said first roll support portions in the directions towards each other along said guide member, and wherein, when the mandrel member is in said collapsed condition, the second roll support portions of the first and second roll supports abut each other.

30. The mandrel member according to claim 24, wherein the mandrel member comprises at least one retaining member between said guide member and said first or second roll supports for maintaining the mandrel member in a collapsed condition, said guide member comprises said retaining member, and said guide member comprises a protrusion forming said retaining member.

* * * * *